US006766121B2

(12) United States Patent
Nonaka et al.

(10) Patent No.: US 6,766,121 B2
(45) Date of Patent: Jul. 20, 2004

(54) IMAGE FORMING APPARATUS THAT PERIODICALLY DISCHARGES WASTE TONER AND METHOD OF OPERATION THEREOF

(75) Inventors: Hirotomo Nonaka, Tokyo (JP); Satoshi Ishikawa, Fukushima (JP); Tsutomu Yamane, Tokyo (JP)

(73) Assignee: OKI Data Corporation, Tokyo (JP)

( * ) Notice: Subject to any disclaimer, the term of this patent is extended or adjusted under 35 U.S.C. 154(b) by 0 days.

(21) Appl. No.: 10/304,010

(22) Filed: Nov. 26, 2002

(65) Prior Publication Data

US 2003/0123907 A1 Jul. 3, 2003

(30) Foreign Application Priority Data

Nov. 26, 2001 (JP) ..... 2001-358995
Jul. 9, 2002 (JP) ..... 2002-199611

(51) Int. Cl.[7] ..... G03G 15/00; G03G 15/08

(52) U.S. Cl. ..... 399/24; 399/27; 399/72; 399/79; 399/257

(58) Field of Search ..... 399/24–27, 31, 399/34, 35, 72, 79, 257

(56) References Cited

U.S. PATENT DOCUMENTS 5,223,895 A * 6/1993 Saitoh ..... 399/24
6,102,508 A * 8/2000 Cowger ..... 347/7
6,233,408 B1 * 5/2001 Allen ..... 399/24 X
6,453,129 B1 * 9/2002 Simpson et al. ..... 399/27 X
6,584,290 B2 * 6/2003 Kurz et al. ..... 399/24 X

* cited by examiner

*Primary Examiner*—William J. Royer
(74) *Attorney, Agent, or Firm*—Rabin & Berdo, P.C.

(57) ABSTRACT

An image forming apparatus an electrophotographic image forming section and a controller. The image forming section forms a toner image on a print medium. When a cumulative operation reaches a predetermined value, the controller causes the image forming section to form the toner image of a pattern image on the print medium. The pattern image is at least one of a number of pattern images aligned in an advance direction, the number of pattern images being increased in accordance with a cumulative print duty. The cumulative operation includes a number of print jobs, a number of printed pages, and a number of rotations of an image drum. The number of printed pages has a print duty less than a predetermined value.

22 Claims, 18 Drawing Sheets

FIG.12

ACTIVITY REPORT

| DATA | TIME | DISTANT STATION ID | MODE | PAGES | RESULT |
|---|---|---|---|---|---|
| 09/25 | 10 : 10 | ABCDEFG | TX | 3 | OK |
| 19/25 | 10 : 30 | XYZ | RX | 5 | OK |

FIG.13

ACTIVITY REPORT

| DATA | TIME | DISTANT STATION ID | MODE | PAGES | RESULT |
|---|---|---|---|---|---|
| 09/25 | 10 : 10 | ABCDEFG | TX | 3 | OK |
| 19/25 | 10 : 30 | XYZ | RX | 5 | OK |

IMAGE FORMING APPARATUS THAT PERIODICALLY DISCHARGES WASTE TONER AND METHOD OF OPERATION THEREOF

FIELD OF THE INVENTION

The present invention generally relates to an image forming apparatus and more particularly to a method of discharging waste toner from the image forming apparatus.

DESCRIPTION OF THE RELATED ART

For printers and image forming apparatus, electrophotography has come into common use for its high printing speed and reliable storage of images.

In an electrophotographic apparatus, a charging roller rotates in contact with a photoconductive drum to negatively charge the surface of the photoconductive drum. Then, light generated from a laser or an LED array illuminates the charged surface of the photoconductive drum in accordance with print data to selectively dissipate the charges, thereby forming an electrostatic latent image on the surface of the photoconductive drum. A developing roller rotates in contact with the photoconductive drum, thereby depositing negatively charged toner particles to the electrostatic latent image to form a visible toner image. A print medium is advanced with its front side in contact with the rotating photoconductive drum and its back side charged positively, so that the toner image is transferred onto the front side of the print medium by the Coulomb force of the positively charged back side.

The surface of toner particles is covered with surface additives such as an abrasive and silica. When the toner particles are rubbed between a toner supplying roller and a developing roller, the physical forces applied to the toner particles damage the particle surfaces to remove the surface additives.

Heat and force resulting from friction cause the toner particles to break and/or stick to other particles into agglomerates. Such deteriorated toner particles accumulate in a developing unit and cause non-uniform image density and poor reproducibility of dots.

For example, a large number of pages are sometimes printed with a low print duty, i.e., the ratio of a total area of a print medium occupied by toner to a total area of the print medium not occupied by toner is large. Low print duty implies that the toner particles stay for a longer time within an ID (image drum) unit and is therefore subject to physical damages due to friction. Silica is one of the surface additives and adds fluidity to the toner particles so that toner can be agitated efficiently and toner images can be transferred efficiently. Abrasives prevent "filming" of the toner from being formed on a developing blade. Toner particles from which surface additives have come off are apt to stick together into agglomerates and are deposited on the developing blade.

The developing blade is provided in order to make a thin layer of toner on the surface of the developing roller. If agglomerates of toner are formed on the developing blade, a uniform thin layer of toner cannot be formed on the developing roller so that no toner is deposited to an image area on the photoconductive drum that corresponds to the agglomerates of toner.

If images are printed with a high print duty (i.e., a total area occupied by the toner to a total area not occupied by the toner is low) after images are printed with a low print duty, image areas that correspond to the toner agglomerates are not properly developed. This results in white lines on the printed images.

SUMMARY OF THE INVENTION

An object of the invention is to provide an image forming apparatus and a method of controlling the image forming apparatus in such a way that even when printing is performed with a low print duty after printing with a high print duty, the print quality is maintained.

Another object of the invention is to provide an image forming apparatus and a method of controlling the image forming apparatus by employing firmware instead of improving the toner, surface additives to the toner, or toner agitating mechanisms.

An image forming apparatus includes an electrophotographic image forming section and a controller. The electrophotographic image forming section forms a toner image on a print medium. The controller causes the image forming section to form the toner image of a pattern image on the print medium when a cumulative operation reaches a predetermined value.

The cumulative operation is one of a number of print jobs, a number of printed pages, and a number of rotations of an image drum.

The cumulative operation is a number of printed pages having a print duty less than a predetermined value.

The pattern image is at least one of a number of pattern images aligned in an advance direction, the number of pattern images being increased in accordance with a print duty.

The controller divides a print region of the print medium into a plurality of sub-divided areas that are aligned in a traverse direction, and calculates a cumulative print duty in each one of the plurality of sub-divided areas and causes the image forming section to print the pattern image in a sub-divided area in which the cumulative print duty is less than a predetermined value.

The controller causes the image forming section to print an activity report at predetermined time intervals and the pattern image together with the activity report on the print medium.

The image forming section includes a photoconductive drum, a developing unit that supplies toner to the photoconductive drum to form the toner image, a transfer unit that transfers the toner image from the photoconductive drum to the print medium, and a cleaning unit that collects waste toner from the photoconductive drum. When the waste toner is collected from the image forming section, the transfer unit receives such a voltage that no transfer of toner occurs between the photoconductive drum and the transfer unit so that the waste toner is collected through the cleaning unit.

The image forming section further includes a charging unit that uniformly charges a surface of the photoconductive drum, an exposing unit that illuminates the charged surface of the photoconductive drum to form an electrostatic latent image of a predetermined pattern image in accordance with a difference between a predetermined amount of printing and a number of actually printed dots, and a developing unit that supplies the toner to the electrostatic latent image.

The controller divides a print region of the print medium into three areas that are aligned in a traverse direction, an area between two areas having a smaller print duty than the two areas.

A method of controlling an image forming apparatus includes the steps of:

causing an electrophotographic image forming section to form a toner image on a print medium; and causing the image forming section to form the toner image of a pattern image on the print medium when a cumulative operation reaches a predetermined value.

In the method of controlling an image forming apparatus, the cumulative operation is one of the number of print jobs, the number of printed pages, and the number of rotations of an image drum.

In the method of controlling an image forming apparatus, the cumulative operation is the number of printed pages having a print duty less than a predetermined value.

In the method of controlling an image forming apparatus, the pattern image is at least one of the number of pattern images aligned in an advance direction, the number of pattern images being increased in accordance with a print duty.

The method of controlling an image forming apparatus further includes the steps of:

dividing a print region of the print medium into a plurality of sub-divided areas that are aligned in an advance direction; and calculating a cumulative print duty in each one of the plurality of sub-divided areas and causes the image forming section to print the pattern image in a sub-divided area in which the cumulative print duty is less than a predetermined value.

The method of controlling an image forming apparatus, further includes the step of:

causing the image forming section to print an activity report at predetermined time intervals and the pattern image together with the activity report on the print medium.

In the method of controlling an image forming apparatus, the image forming section includes a photoconductive drum, a developing unit that supplies toner to the photoconductive drum to form the toner image, a transfer unit that transfers the toner image from the photoconductive drum to the print medium, and a cleaning unit that collects waste toner from the photoconductive drum. The method further includes applying such a voltage that no transfer of toner occurs between the photoconductive drum and the transfer unit so that the waste toner, is collected through the cleaning unit, the voltage being applied when the waste toner is collected from the image forming section.

In the method of controlling an image forming apparatus, the image forming section further includes:

a charging unit that uniformly charges a surface of the photoconductive drum;

an exposing unit that illuminates the charged surface of the photoconductive drum to form an electrostatic latent image of a predetermined pattern image in accordance with a difference between a reference print duty and an actual print duty; and a developing unit that supplies to the electrostatic latent image;

wherein the method includes causing the developing unit to supply the toner to the electrostatic latent image.

The method of controlling an image forming apparatus further includes dividing a print region of the print medium into three areas that are aligned in a traverse direction, an area between two areas having a smaller print duty than the two areas.

A further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 12 illustrates an example of a checker flag (checker strip) pattern according to the fifth embodiment;

FIG. 13 illustrates an example of a solid black belt (elongated strip) pattern according to the fifth embodiment;

DETAILED DESCRIPTION OF THE INVENTION

First to fifth embodiments are directed to printing a predetermined pattern image on a print medium, thereby discharging the waste toner from the image forming apparatus.

Sixth to eighth embodiments are directed to discharging waste toner to a cleaning device and not printing on a print medium, thereby preventing waste of print medium.

First Embodiment

Figure 1A:
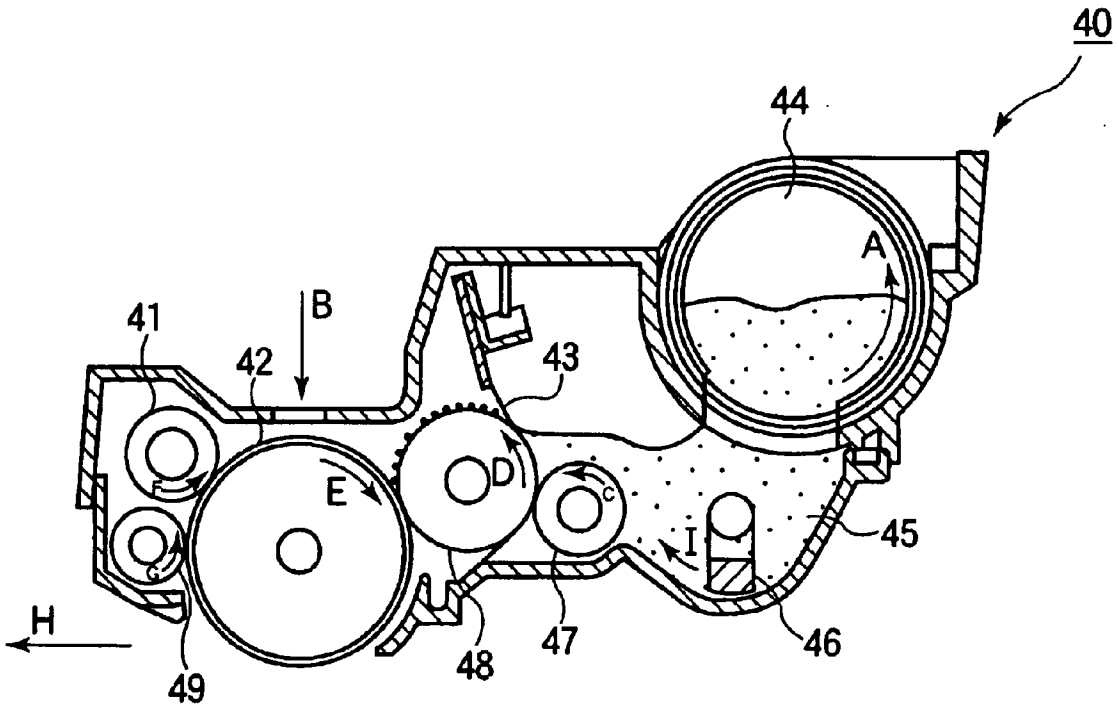
FIGS. 1A and 1B are cross-sectional views of an ID unit according to a first embodiment of the invention.
Figure 1B:
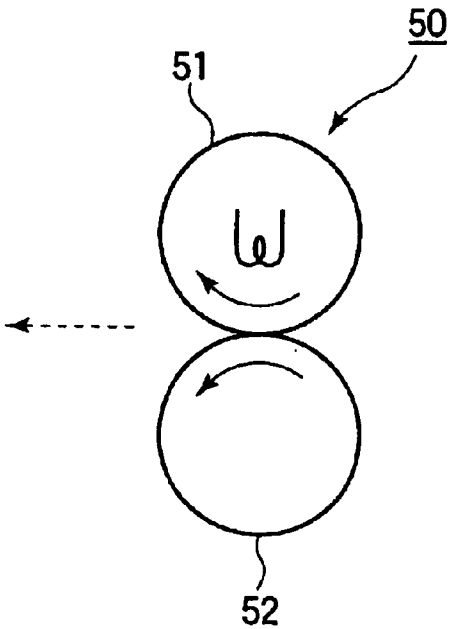

FIGS. 1A and 1B are cross-sectional views of an ID (image drum unit) unit, according to a first embodiment of the invention.

Referring to FIG. 1A, an ID unit 40 is an image forming section based on electrophotography for use in an image forming apparatus according to the present invention. The ID unit 40 forms a toner image and transfers the toner image onto a print medium, not shown, that advances in contact with a photoconductive drum 42 in a direction shown by arrow H. The print medium then advances to a fixing unit 50 where the toner image on the print medium is fused into a permanent image.

The image forming apparatus according to the first embodiment may be in the form of a copying machine, a printer, a facsimile machine, or a composite apparatus having the functions of electrophotographic printing. The photoconductive drum 42 rotates in a direction shown by arrow E. A charging roller 41 rotates in a direction shown by arrow F in contact with the photoconductive drum 42, thereby negatively charging the surface of the photoconductive drum 42. The negatively charged surface of them photoconductive drum 42 is illuminated by light emitted by a laser type exposing unit or an LED type exposing unit, not shown, in a direction shown by arrow B in accordance with print data, so that the charges on the surface of the photoconductive drum 42 are dissipated to form an electrostatic latent image. A developing roller 48 rotates in contact with the photoconductive drum 42 in a direction shown by arrow D to deposit toner 45 to the electrostatic latent image on the surface of the photoconductive drum 42.

A toner supplying roller 47 rotates in contact with the developing roller 48 in a direction shown by arrow C, thereby supplying toner 45 to the developing roller 48. An agitating shaft 46 rotates in a direction shown by arrow I to agitate the toner 45. A developing blade 43 is in pressure contact with the developing roller 48 to form a thin layer of the toner 45 on the developing roller 48. When a shutter is rotated in a direction shown by arrow A, the toner 45 is replenished from a toner cartridge 44 into a toner-holding space. The toner 45 is negatively charged due to the friction between the developing roller 48 and the developing blade 43. The toner 45 in a toner chamber is delivered toward the toner supplying roller 47 while being agitated.

The charged toner 45 on the developing roller 48 migrates from the developing roller 48 to the photoconductive drum 42 by the Coulomb force through an electric field developed due to the potential difference between the developing is roller 48 and the photoconductive drum 42. The toner particles adhere to the electrostatic latent image on the photoconductive drum 42 to develop the electrostatic latent image into a toner image. This negatively charged toner image is transferred onto the front side of a print medium that is positively charged from the back side by a transfer device, not shown. Residual toner particles on the photoconductive drum 42 are removed by a cleaning roller 49 that rotates in a direction shown by arrow G.

The print medium onto which the toner image has been transferred is advanced in the direction shown by arrow H, and fed into the fixing unit 50 downstream of the transfer station. The fixing unit 50 includes a heat roller 51 in pressure contact with a pressure roller 52. The heat roller 51 has a built-in heater. The heat roller 51 and pressure roller 52 rotate in contact with each other to pull in the print medium between the heat roller 51 and the pressure roller 52 so that the toner image is fused on the print medium.

Figure 2:
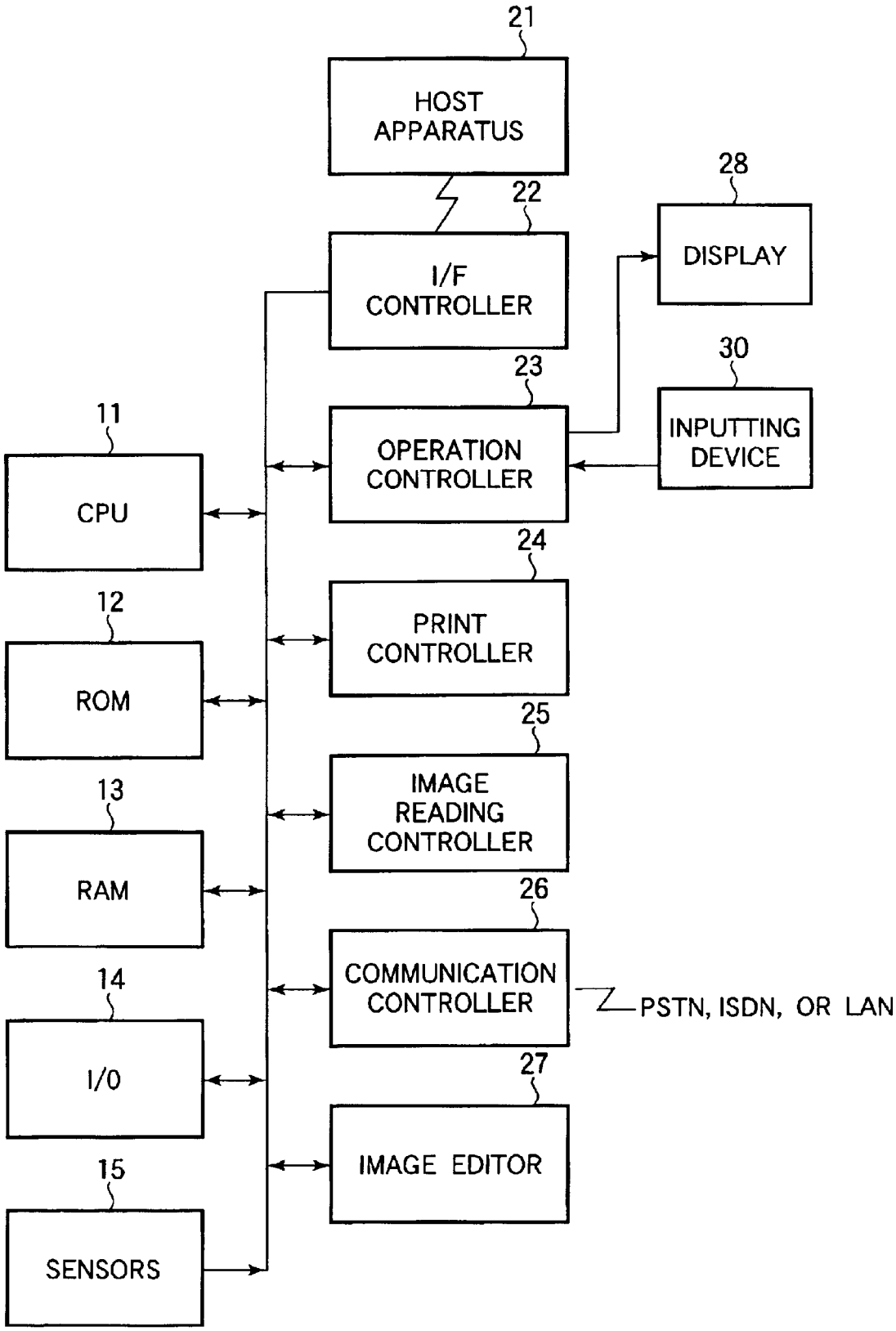
FIG. 2 is a block diagram illustrating the controller of an image forming apparatus according to the first embodiment.

FIG. 2 is a block diagram illustrating the controller of an image forming apparatus according to the first embodiment.

Referring to FIG. 2, a CPU 11 is an arithmetic operation unit that controls the operation of the image forming apparatus. A ROM 12 is a semiconductor memory such as a flash memory in which various control programs and various data are stored. The CPU 11 converts print data into bit-map data, which in turn is stored into a buffer area of a RAM 13. The RAM 13 takes the form of a semiconductor memory such as a flash memory and provides a work area, for example, print job counts. Reference numeral 14 denotes an 110 port. Reference numeral 15 denotes various sensors such as a temperature sensor and a print medium detecting sensor.

The CPU 11 communicates with a host apparatus 21 such as a host computer through an I/F (interface) controller 22. An operation controller 23 is connected to a display 28 such as an LCD and an inputting device 30 such as a ten-key pad, push buttons, or a touch panel through which the user can perform overall control and operations of the image forming apparatus.

A print controller 24 controls the operations of the respective sections during electrophotographic processes such as charging, exposing, developing, and transferring for printing image data on a print medium. An image-reading controller controls an image reading device such as an image scanner, not shown.

A communication controller 26 is connected to communication lines such as ISDN (Integrated Service Digital Network) and LAN (Local Area Network), and controls data communications for the facsimile and the Internet through these communication lines. Image data is read by the image-reading device, received through the facsimile and the Internet, and edited in an image editor or image editing section 27. Then, the image data is processed to adapt the data to the interface of the exposing unit. Such image data can be communicated over a bus line.

The operation of an image forming apparatus of the aforementioned configuration will be described.

Figure 3:
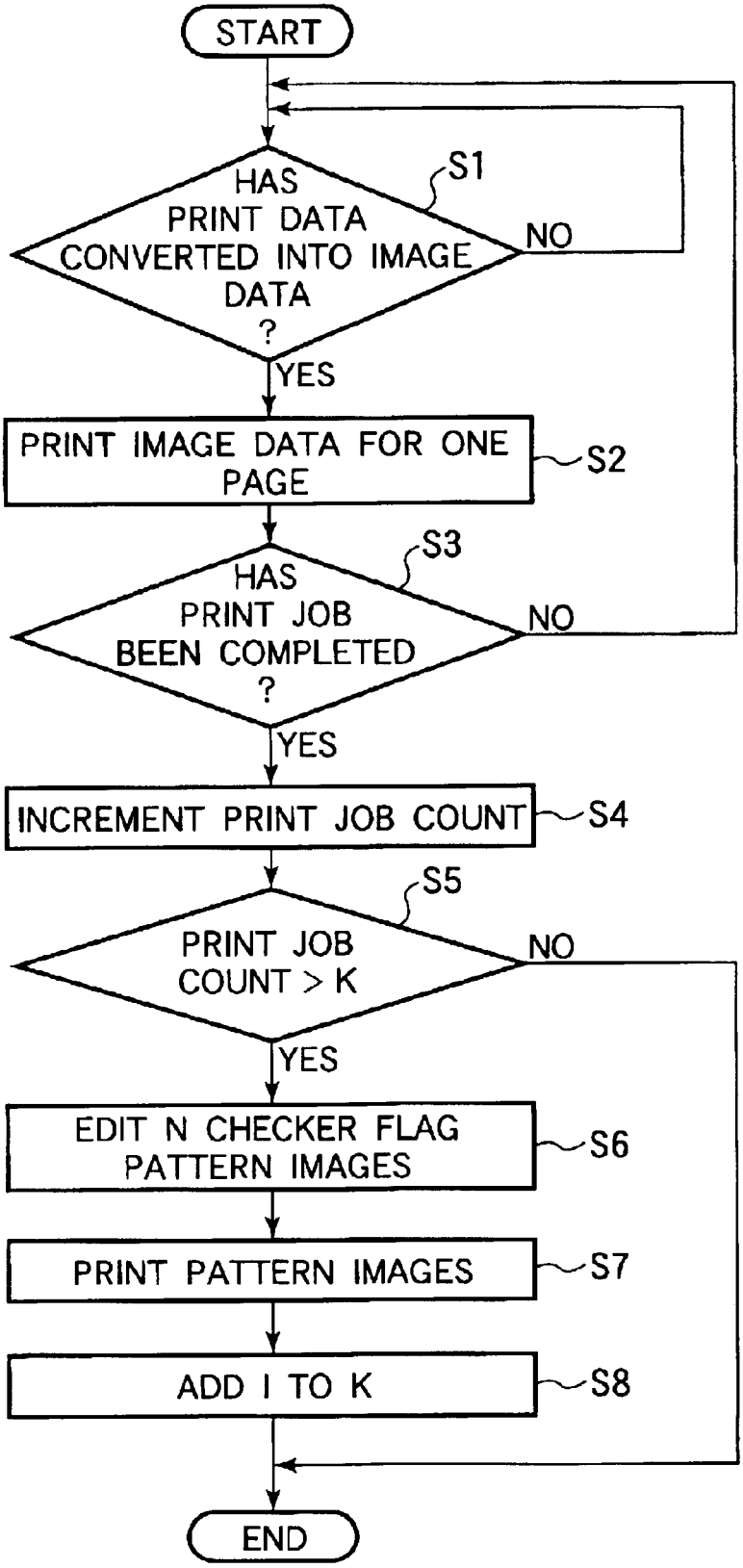
FIG. 3 is a flowchart illustrating the operation of an image forming apparatus according to the first embodiment.

FIG. 3 is a flowchart illustrating the operation of an image forming apparatus according to the first embodiment.

Figure 4:
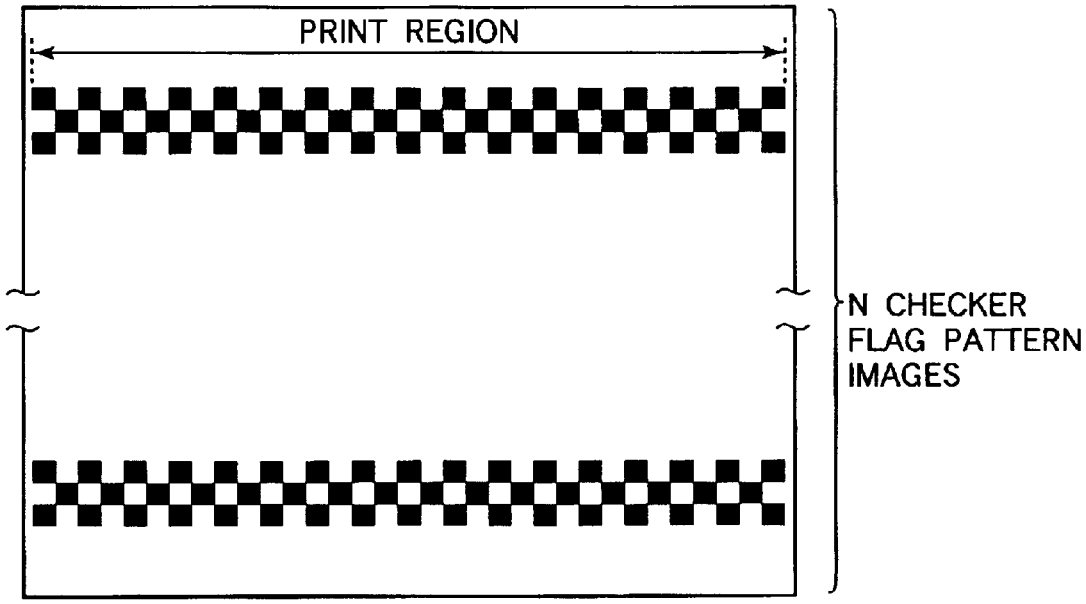
FIG. 4 illustrates an example of a pattern image used in the first embodiment.

FIG. 4 illustrates an example of a pattern image used in the first embodiment.

Figure 5:
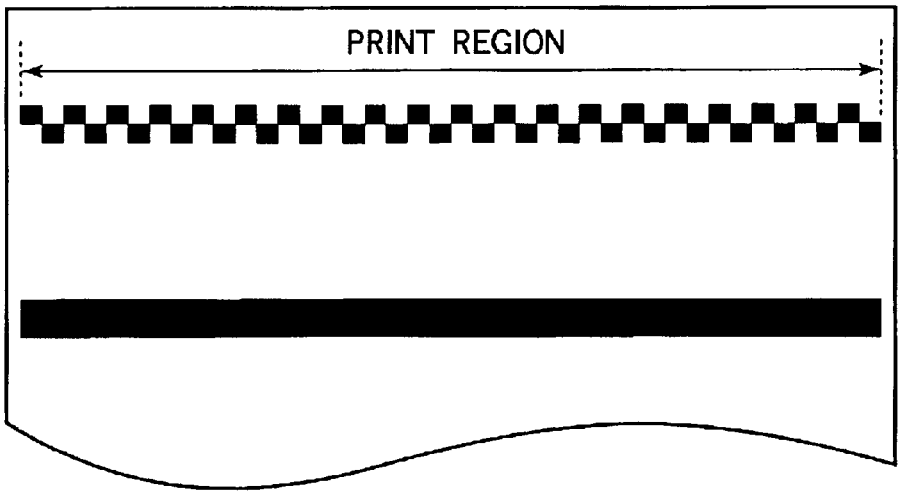
FIG. 5 illustrates anther example of a pattern image used in the first embodiment.

FIG. 5 illustrates another example of a pattern image used in the first embodiment.

Referring to FIG. 3, at step S1, the CPU 11 determines whether print data is properly converted into image data and stored in a buffer area in the RAM 13. The print data includes data received from the host apparatus 21, data received by the communication controller 26 over the communication lines such as PSTN, ISDN, and LAN, and data read by the image reading controller 25. If the data has been converted into image data, then the program proceeds to step S2 where the CPU 11 transfers the image data from the buffer area of the RAM 13 to the print controller 24. The print controller 24 then performs printing of the image data on the print medium under the control of the CPU 11.

When image data for one page has been printed, the CPU 11 determines at step S3 whether the print job has been completed. If YES, then the program proceeds to step S4 where the print job count stored in a work area of the RAM 13 is incremented by 1 regardless of the size (i.e., the number of pages) of the print job. The print job count is numerical data that indicates the cumulative operation of ID unit 40.

Then, at step S5 the CPU compares the print job count stored in the work area of the RAM 13 with a value K. The initial value of K is selected to be a predetermined value I. If the print job count is greater than the value K, then the CPU 11 controls the image editing section 27 to edit a predetermined number N of checker flag (elongated strip) pattern images to be aligned in the direction of travel of the print medium (step S6). Each of N pattern images extends fully across the print region of the print medium. The edited N pattern images as shown in FIG. 4 are stored in the buffer area of the RAM 13. The pattern image may be a combination of a checker flag pattern image and a solid black belt pattern as shown in FIG. 5.

Then, the CPU 11 transfers the N pattern images in the buffer area of the RAM 13 to the print controller 24, which in turn prints the pattern images on the print medium (step S7) under the control of the CPU 11. Then, at step SB, the CPU 11 adds the value I to the value K. The CPU 11 stores the increased value K into a work area of the RAM 13.

The operation of the image forming apparatus may be modified as follows: When the print job count becomes larger than the value K, the operation controller 23 causes the display 28 to display an indication that prompts the printing of the aforementioned pattern image. Then, in response to the indication, the operator operates the inputting device 30 to perform the printing of the pattern image.

As described above, when the value indicative of the cumulative operation of the ID unit 40, i.e., the print job count reaches a reference value, a pattern image that extends substantially all across the width of the print medium is printed. In other words, the pattern image is printed every I print jobs.

The print job count is a count that is referred to in order to prevent adverse effects due to physical damage to the toner 45 remaining in the toner chamber of the ID unit 40. If an agitating shaft 46 (FIG. 1) collides with the particles of toner 45 that have stayed in the toner chamber for a long time, the toner particles are physically damaged so as to lose their surface additives such as abrasives and silica covering the surfaces of the toner particles. Toner particles that have lost their surface additives become easy to stick to one another to form large agglomerates that eventually are deposited on the developing blade 43. Thus, the toner 45 cannot be delivered to the surface of the photoconductive drum 42, so that toner cannot be properly deposited to areas of an image that correspond to areas of the developing blade 43 to which toner agglomerates are deposited. Thus, when an image that consumes a larger amount of toner is developed after images that consume a smaller amount of toner are developed, areas of the image that are blocked by toner agglomerates cannot be developed. This causes white lines to appear in the printed image, resulting in deteriorated print quality. If printing is continued to perform a larger number of print jobs under this condition, toner is increasingly damaged.

When a predetermined number of print jobs are carried out, i.e., when the print job count exceeds the value K, a predetermined number of pattern images are printed all across the width of the print medium. Thus, this forcibly consumes the toner 45 that was not consumed for developing images and stayed for a long time in the toner chamber of the ID unit 40 to be physically damaged by the agitating shaft 46. This prevents the deposition of toner particles on the developing blade 43 and the deterioration of print quality.

The value K is a measure for preventing such a phenomenon that surface additives of the toner particles come off the toner particles and adhere to the developing blade 43. The value I is determined through experiment and analysis of all print control parameters such as print process conditions and toner properties.

In reality, the number of pages varies depending on the print job, so that the print job count does not represent the true cumulative operation of the image forming sections. To solve this problem, page count may be employed in place of print job count. The page count may be incremented every time one page has been printed so that when the page count exceeds a reference value M, the pattern image is printed.

Employing the page count allows the pattern image to be printed every time a predetermined number (i.e., reference value M) of pages has been printed. Such an operation not only prevents variations of effect in cleaning toner agglomerates but also effectively eliminates the residence of damaged toner particles for a long time in the toner chamber of the ID unit 40.

Strictly speaking, the degree of damage of toner in the toner chamber of the ID unit 40 is proportional to the number of rotations of the image drum or photoconductive drum 42, rather than the number of printed pages. When printing is performed for a multi-page print job, a cleaning sequence is not executed between pages within the same print job but only at the end of the print job.

Thus, the rotation count of the photoconductive drum 42 may be employed in place of the print job count and page count, in which case, when the cumulative rotation count exceeds a reference value, the pattern image can be printed.

Employing the rotation count allows the pattern image to be printed every time a predetermined number of pages have been printed. Such an operation not only prevents variations of effect in cleaning toner agglomerates but also effectively eliminates the residence of damaged toner particles for a long time in the toner chamber of the ID unit 40.

Second Embodiment

An image forming apparatus according to a second embodiment is of the same structure as the first embodiment.

Figure 6:
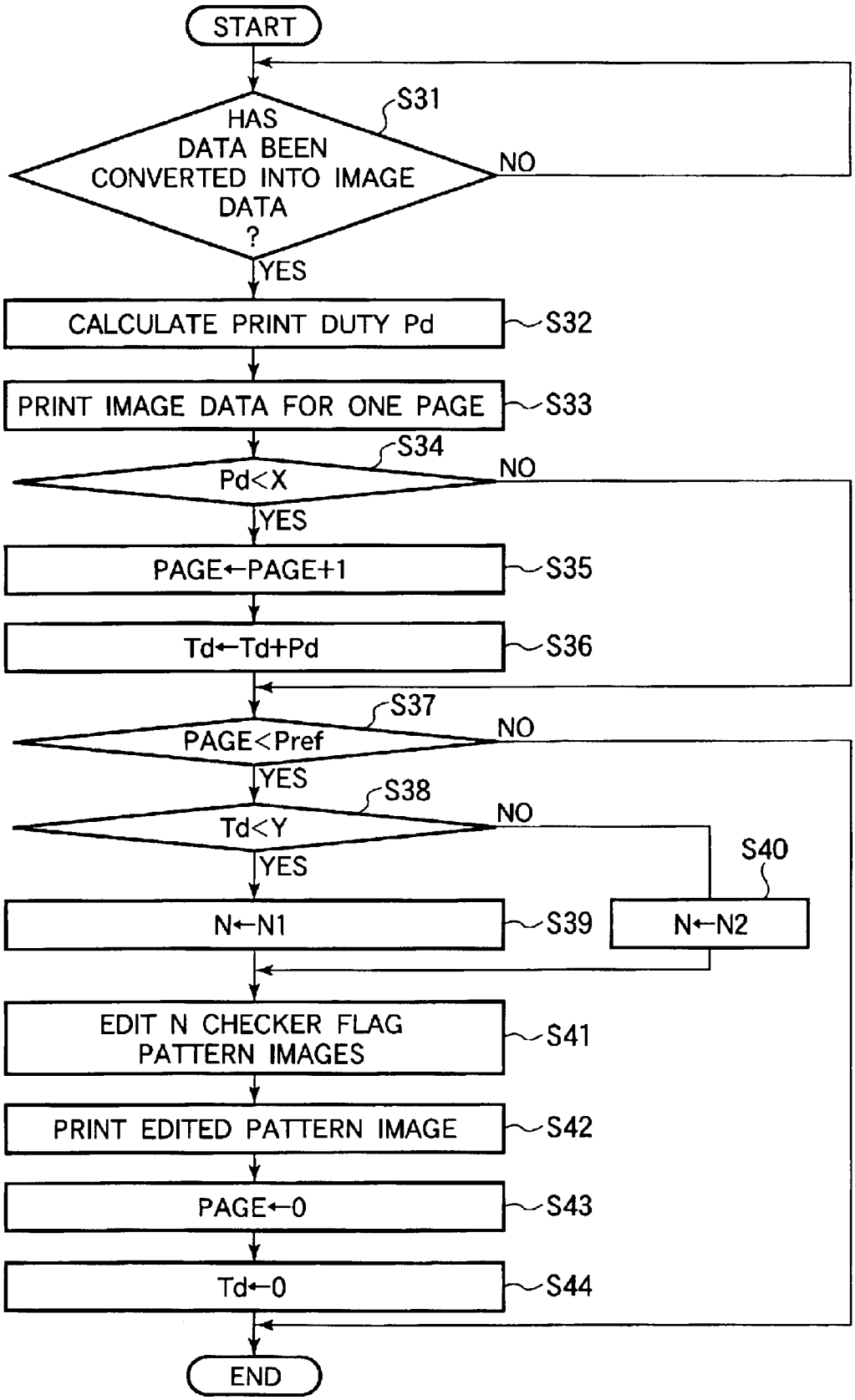
FIG. 6 is a flowchart illustrating the operation of an image forming apparatus according to the second embodiment.

FIG. 6 is a flowchart illustrating the operation of an image forming apparatus according to the second embodiment.

Print duty is the ratio of the number of actually printed dots in a predetermined area on the print medium to a total number of dots that can be printed in the predetermined area.

When a print duty is low, less toner 45 is consumed and therefore the toner 45 stays in the toner chamber of the ID unit 40 for a relatively longer time. This implies that there are more chances of toner particles being damaged by the agitating shaft 46. In the second embodiment, when printing has been carried out for a predetermined number of pages with a print duty Pd less than a predetermined value X, the pattern image that extends substantially all across the width of the print medium is printed. The number of printed pattern images increases with increasing cumulative value of print duty at that time.

Referring to FIG. 6, at step S31, the CPU 11 determines whether print data for one page is properly converted into image data and stores the converted image data in a buffer area in the RAM 13. The image data includes data received from the host apparatus 21, data received by the communication controller 26 over the communication lines such as PSTN, ISDN, and LAN, and data read by the image reading controller 25. If YES, then the program proceeds to step S32 where the CPU 11 calculates the print duty Pd of the image data and stores it into a work area of the RAM 13. Subsequently, at step S33, the CPU 11 transfers the image data from the buffer area of the RAM 13 to the print controller 24, which in turn prints the data on a print medium under the control of the CPU 11.

Upon completion of the printing of one page of the image data, at step S34, is the CPU 11 compares the print duty Pd stored in the work area of the RAM 13 with a predetermined reference value X. If Pd<X, then the program proceeds to step S35 where a page count PAGE stored in the work area of the RAM 13 is incremented. The page count PAGE indicates the number of pages that are printed at the print duty Pd less than the reference value X. The count PAGE is initially zero. The program then proceeds to step S36 where the CPU adds Pd to a cumulative print. duty Td, thereby updating the value of Td. Then, the CPU stores it into the work area of the RAM 13.

Then, at step S37, the CPU 11 compares the page count PAGE with a predetermined reference value Pref to determine whether the number of pages having a print duty Pd less than the reference value X is greater than the reference value Pref. If PAGE>Pref, then the program proceeds to step S38 where the CPU 11 compares the cumulative print duty Td stored in the work area of the RAM 13 with a predetermined reference value Y. If Td<Y, then the CPU proceeds to step S39 where the CPU 11 sets N, i.e., the number of pattern images to be printed, to a is predetermined value N1. If Td≧Y then the program proceeds to step S40 where the CPU sets N to a predetermined value N2, N1 being larger than N2. In other words, the steps S38–S40 are performed to select either a smaller number of pattern images or a larger number of pattern images.

At step S41, the CPU 11 edits N1 or N2 checker flag pattern images as shown in FIG. 4 in a buffer area of the RAM 13. Then, at step S42, the CPU 11 transfers the edited image data from the buffer area of the RAM 13 to the print controller 24, which in turn performs printing of the edited checker flag pattern images on the print medium under the control of the CPU 11.

Then, the CPU 11 clears the page count PAGE at step S43, and clears the cumulative print duty Td stored in the work area of the RAM 13 at step S44.

As described above, when printing has been carried out for a predetermined number of pages with a print duty less than a predetermined value X, the number of pattern images is changed in accordance with a value of the cumulative print duty Td at that time. Thus, the second embodiment prevents the damaged toner from staying for a long time even when printing is performed with a low print duty.

This operation prevents physically damaged toner from staying for a long time in the toner chamber of the ID unit 40, so that the toner agglomerates are not deposited on the developing blade 43.

Third Embodiment

An image forming apparatus according to a third embodiment is of the same structure as the first embodiment.

Figure 7:
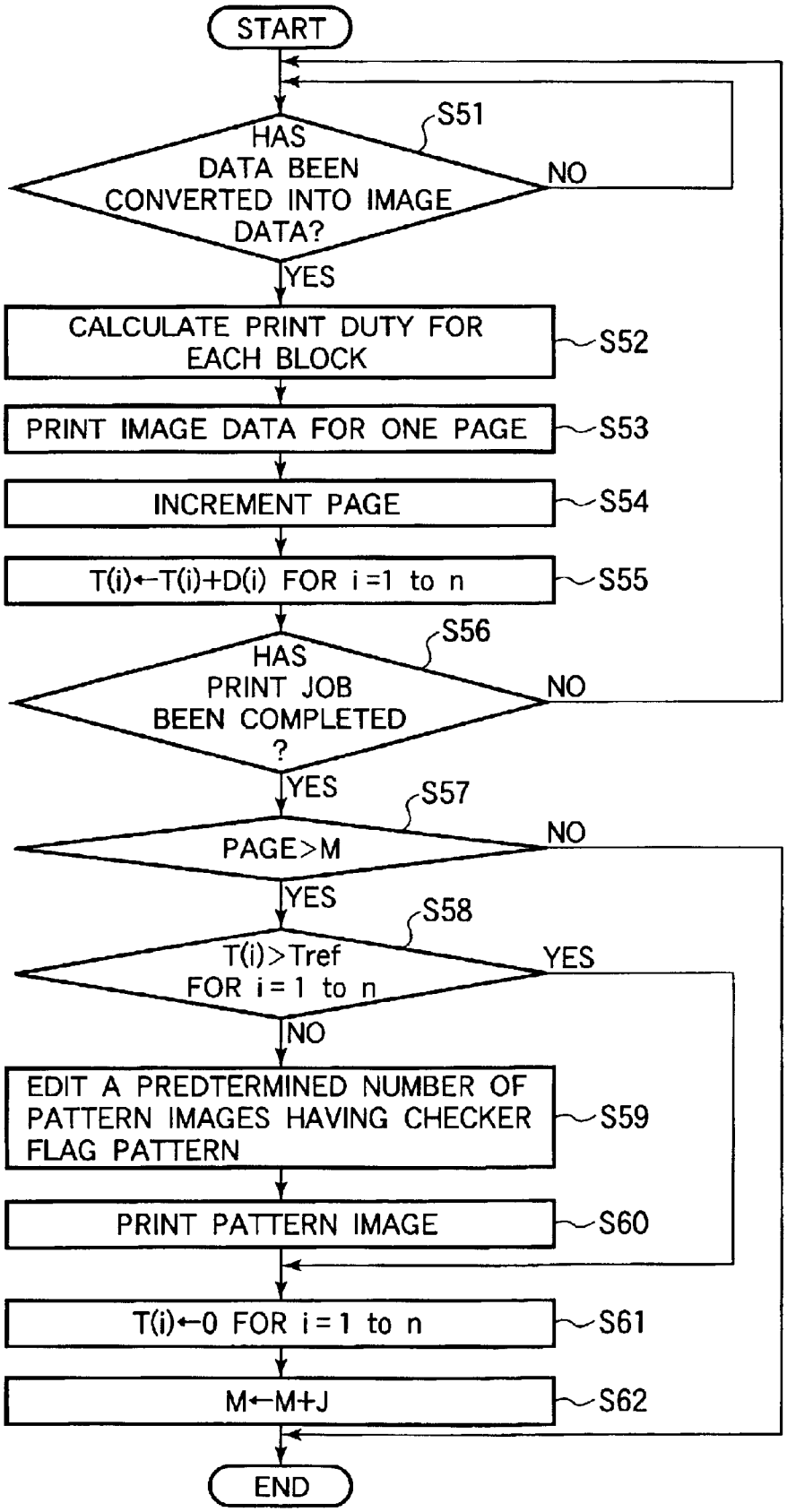
FIG. 7 is a flowchart illustrating the operation of an image forming apparatus according to the third embodiment.

FIG. 7 is a flowchart illustrating the operation of an image forming apparatus according to the third embodiment.

Figure 8:
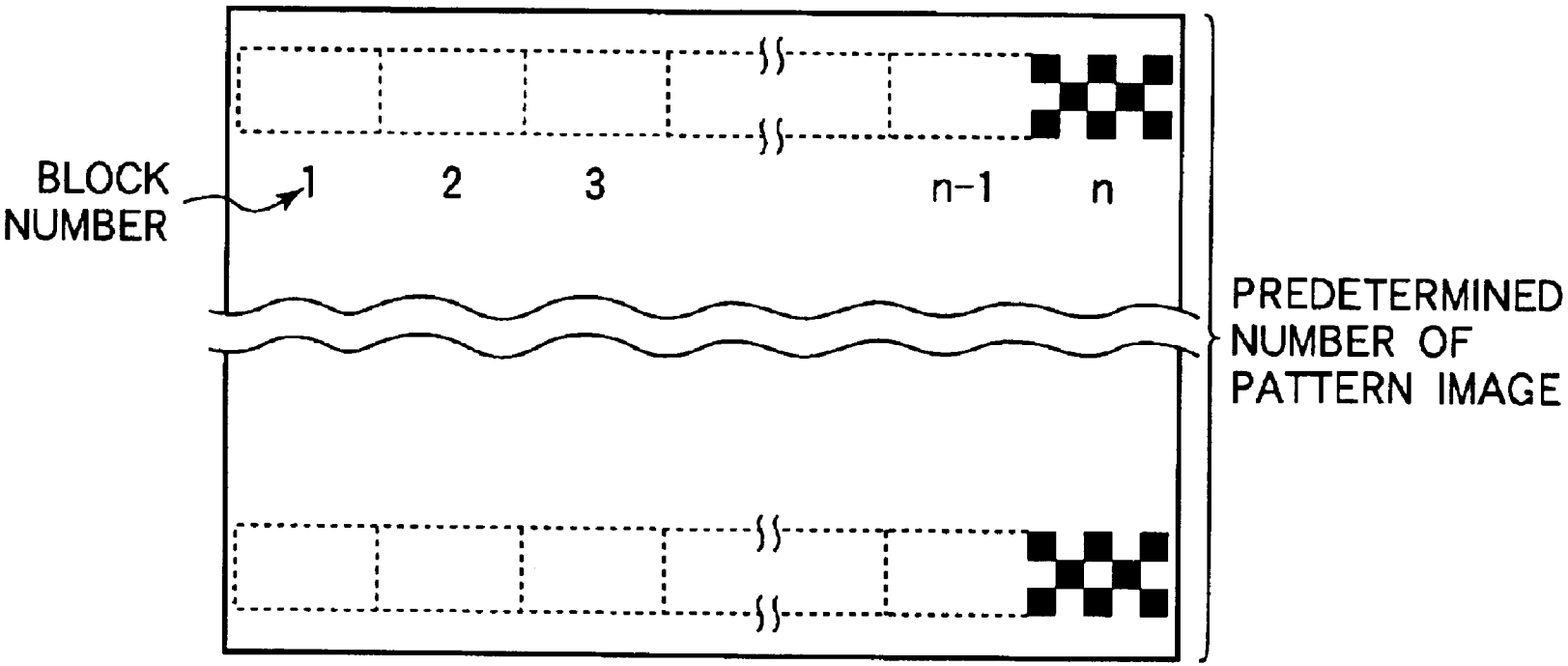
FIG. 8 illustrates an example of pattern image according to the third embodiment.

FIG. 8 illustrates an example of a pattern image according to the third embodiment.

Referring to FIG. 7, at step S51, the CPU 11 determines whether the print data is properly converted into image data and stored in a buffer area in the RAM 13. The print data includes data received from the host apparatus 21, data received by the communication controller 26 over the communication lines such as PSTN, ISDN, is and LAN, and data read by the image reading controller 25. If YES at step S51, then the program proceeds to step S52 where the CPU 11 divides the image data into n blocks in the traverse direction (direction of width of a page of print medium) and calculates a print duty D(i) for the i-th block and stores it into a work area of the RAM 13, where i is from 1 to n. Subsequently, at step S53, the CPU 11 transfers the image data from the buffer area of the RAM 13 to the print controller 24, which in turn prints the data on a print medium under the control of the CPU 11.

Upon completion of the printing of one page of the image data, at step S54, the CPU 11 increments the page count PAGE stored in the work area of the RAM 13. The CPU 11 then calculates at step S55 a cumulative print duty T(i) for the respective blocks up to that page and stores it into the work area of the RAM 13. The aforementioned steps S51–S55 are repeated according to a decision at step S56, until the print job is completed.

Then, at step S57, the CPU 11 compares the page count PAGE stored in the work area of the RAM 13 with the reference value M. The initial value of the page count PAGE is "0". If the page count PAGE is larger than the reference value M, then at step S58 the CPU 11 compares the cumulative print duty T(i) for each block stored in the work area of the RAM 13 with a reference value Tref to determine whether T(i)>Tref for i=1 to n. If YES, then the program proceeds to step S61; if NO, the program proceeds to step S59. At step S59, the CPU 11 edits a predetermined number of pattern images in the buffer area of the RAM 13 and stores the predetermined number of pattern images. Each of the predetermined number of pattern images has a checker flag pattern image only in a corresponding: block or corresponding blocks as shown in FIG. 8. Subsequently, the program proceeds to step S60 where the CPU 11 transfers the image data from the work area of the RAM 13 to the print controller 24, which in turn prints the data on a print medium under the control of the CPU 11.

Then, at step S61, the CPU 11 clears the cumulative print duty T(i) for individual blocks stored in the work area of the RAM 13, and at step S62, the CPU 11 adds a predetermined value J to the value M. The CPU 11 stores the increased value M into the work area of the RAM 13.

As described above, in the third embodiment, the image data to be printed is divided into n blocks that are aligned in the traverse direction (direction of the width of a page). When a cumulative number of printed pages reaches a certain value (i.e., M), the cumulative print duty T(i) for each block is calculated. If T(i)≧Tref, the pattern image is printed only in a corresponding block every time the number of printed pages exceeds the value M, i.e., every I pages of print medium. This operation prevents physically damaged toner from staying for a long time at areas in the toner chamber of the ID unit 40, so that the toner agglomerates are not deposited on particular areas of the developing blade 43. On the other hand, areas in the image having a high print duty consume a large amount of toner, and therefore the toner does not stay for a long time in the ID unit 40. This operation is capable of preventing physically damaged toner particles from staying for a long time in the case of the ID unit 40 and toner agglomerates from being deposited on the developing blade 43.

Fourth Embodiment

An image forming apparatus according to a fourth embodiment is of the same structure as the first embodiment.

Figure 9:
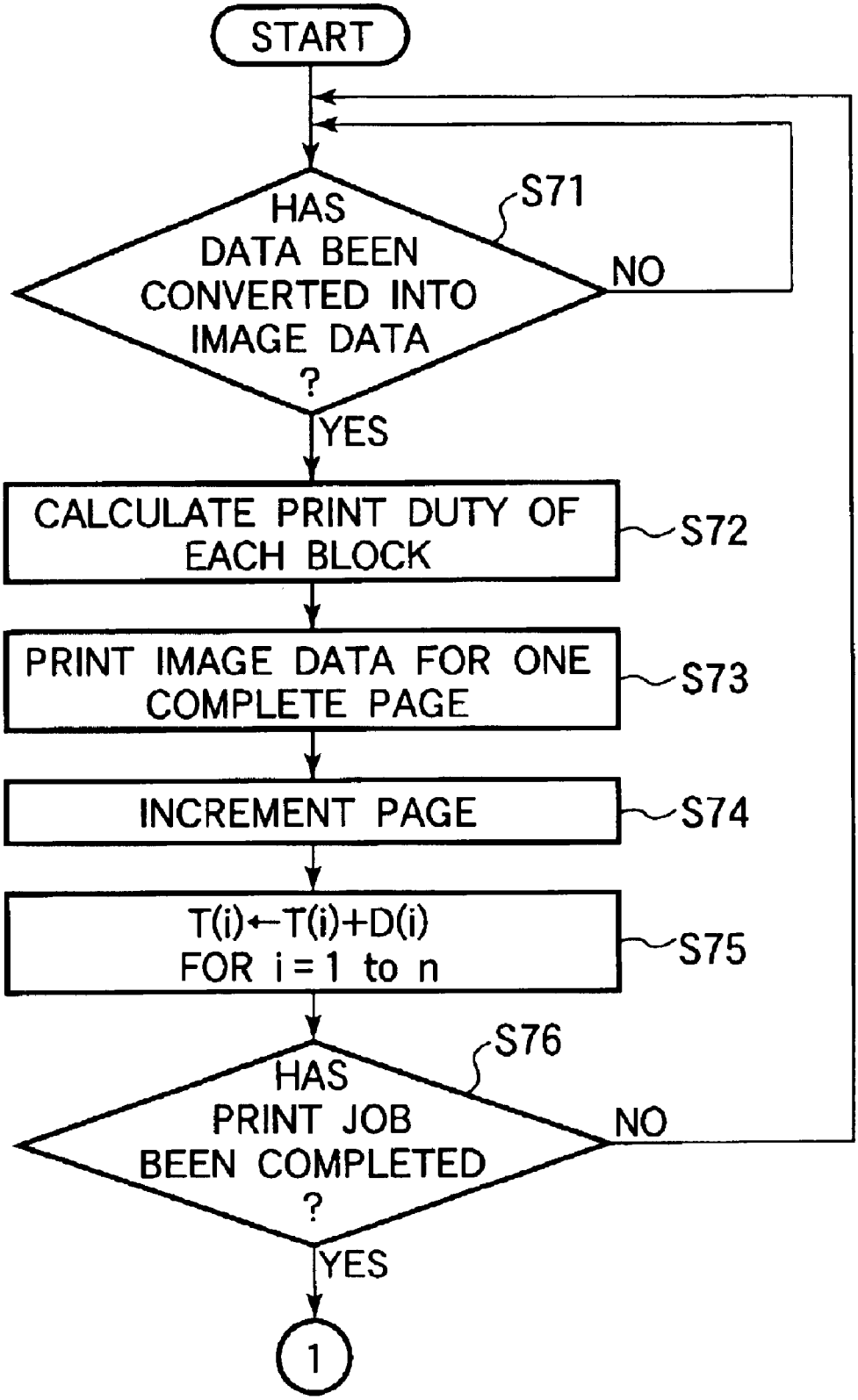
FIGS. 9 and 10 are a flowchart illustrating the operation of an image forming apparatus according to a fourth embodiment.
Figure 10:
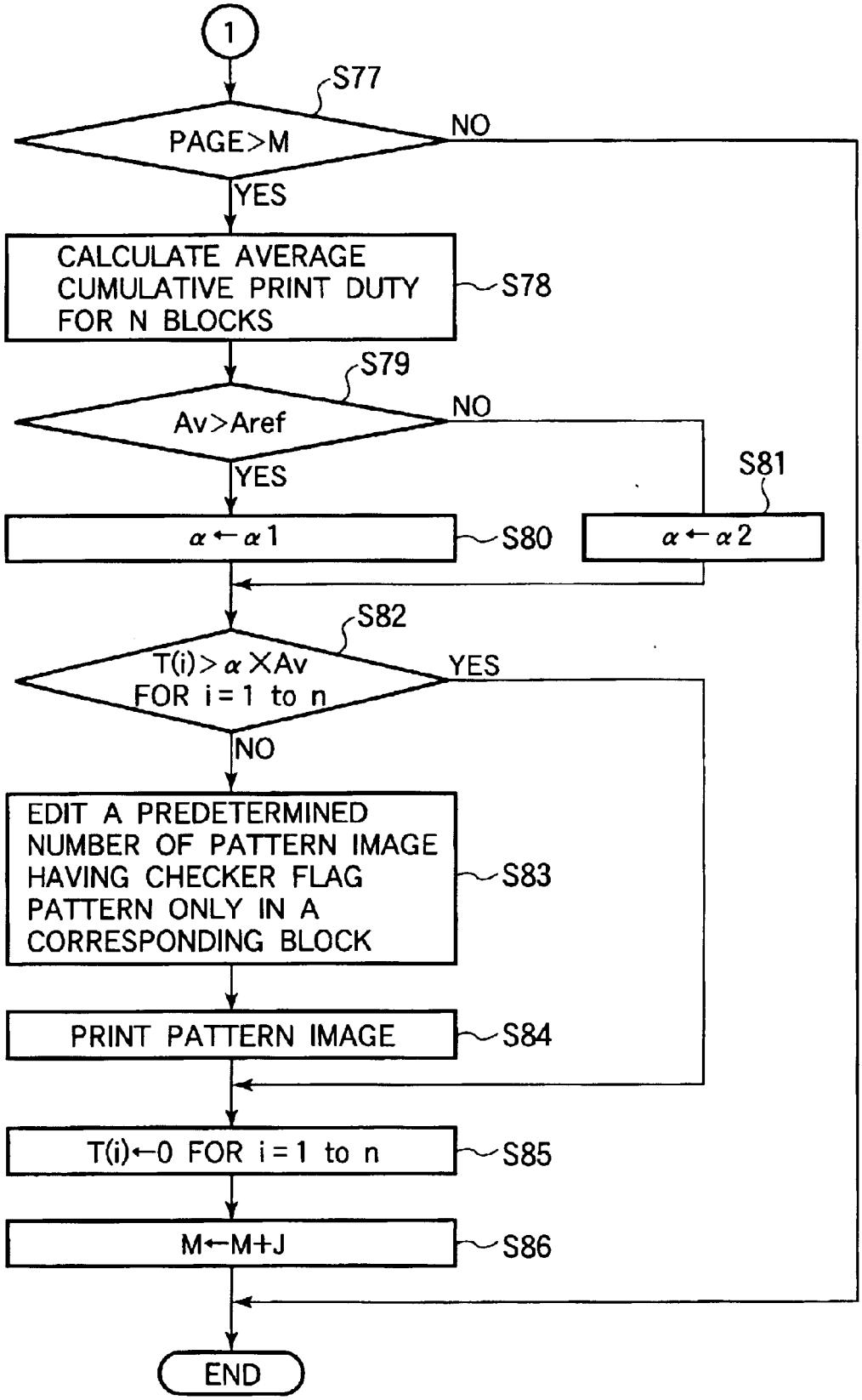

FIGS. 9 and 10 are a flowchart illustrating the operation of the fourth embodiment.

Referring to FIG. 9, at step S71, the CPU 11 determines whether data has been properly converted into image data and stored in a buffer area in the RAM 13. The image data includes data received from the host apparatus 21, data received by the communication controller 26 over the communication lines such as PSTN, ISDN, and LAN, and data read by the image reading controller 25. If YES at S71, then the program proceeds to step S72 where the CPU 11 divides the image data into n blocks that are aligned in the traverse direction (direction of width of a page) and calculates a print duty D(i) for the i-th block where i=1 to n, and stores it into a work area of the RAM 13. Subsequently, at step S73, the CPU 11 transfers the image data from the buffer area of the RAM 13 to the print controller 24, which in turn prints the data on a print medium under the control of the CPU 11.

Upon completion of the printing of one page of the image data, at step S74, the CPU 11 increments the page count PAGE stored in the work area of the RAM 13. At step S75, the CPU 11 calculates a cumulative print duty T(i) for the i-th block where i=1 to n up to that page and stores it into the work area of the RAM 13. The aforementioned steps S71–S75 are repeated according to step S76, until the print job is completed.

Then, at step S77, the CPU 11 compares the page count PAGE stored in the work area of the RAM 13 with the reference value M. The initial value of the reference value M is J. If the page count PAGE is larger than the reference value M, then the CPU 11 calculates (at step S78) an average cumulative print duty Av for blocks by the following equation.

That is, $Av=(T(1)+T(2)+\ldots+T(n))/n$

Then, at step S79, the CPU 11 compares the average print duty Av with a predetermined reference value Aref.

If Av<Aref at step S79, then the CPU 11 sets the work area in the RAM 13 to a constant value $\alpha 1$ (step S80); if Av≧Aref, then the CPU 11 sets the work area in the RAM 13 to a constant value $\alpha 2$ (step S81). The constant values $\alpha 1$ and $\alpha 2$ are in the range of $0<\alpha 1<\alpha 2<1$.

At step S82, the CPU 11 compares a value T(i) with a value$\alpha \times Av$ to determine whether $T(i)>\alpha \times Av$ for i=1 to n. If T(i) and Av are not in the relation that $T(i)>\alpha \times Av$ for i=1 to n, then at step S83, the CPU 11 edits a predetermined number of pattern images to expand in the buffer-area of the RAM 13, each of which pattern images has a checker flag pattern image only in a corresponding block or corresponding blocks as shown in FIG. 8. Subsequently, at step S84, the CPU 11 transfers the image data from the buffer area of the RAM 13 to the print controller 24, which in turn prints the image data on a print medium under the control of the CPU 11.

Then, at step S85, the CPU 11 clears the cumulative print duty T(i) for i-th block (i=1 to n) stored in the work area of the RAM 13, and adds the value J to the reference value M (step S86) and stores the new value of M into the work area of the RAM 13.

In the fourth embodiment, if T(i) and Av are not in the relation that $T(i)>\alpha \times Av$ for i=1 to n, then the pattern image is printed only in an area corresponding to the i-th block. The value of a may be modified so that the toner consumption for printing the pattern image can be reduced.

Alternatively, the fourth embodiment may be modified in such as way that the value a is not used, steps S79–81 are omitted, and a check is made at step S82 to determine whether T(i)>Av. In other words, the print data is divided into n blocks that are aligned in the traverse direction. When a predetermined cumulative number of printed pages is reached, an average cumulative print duty Av for each block is calculated. Then, Av is compared with T(i). If T(i)>Av for i–1–n, the pattern image is printed only in an area corresponding to the i-th block. This operation is effective in removing physically damaged toner particles from particular areas in the case of the ID unit 40 corresponding to the n-th block.

Fifth Embodiment

An image forming apparatus according to a fifth embodiment is of the same structure as the first embodiment.

An image forming apparatus according to the fifth embodiment is a composite apparatus that includes the functions of a facsimile machine and a printer. The fifth embodiment will be described with respect to a case in which image data is received through a facsimile communication under the control of the communication controller. 26 over the communication lines of PSTN, ISDN, or LAN. The image forming apparatus prints out administration reports such as a communication administration report representative of reception conditions of various data.

The operation of the image forming apparatus of the aforementioned configuration will be described with reference to FIGS. 11–13.

Figure 11:
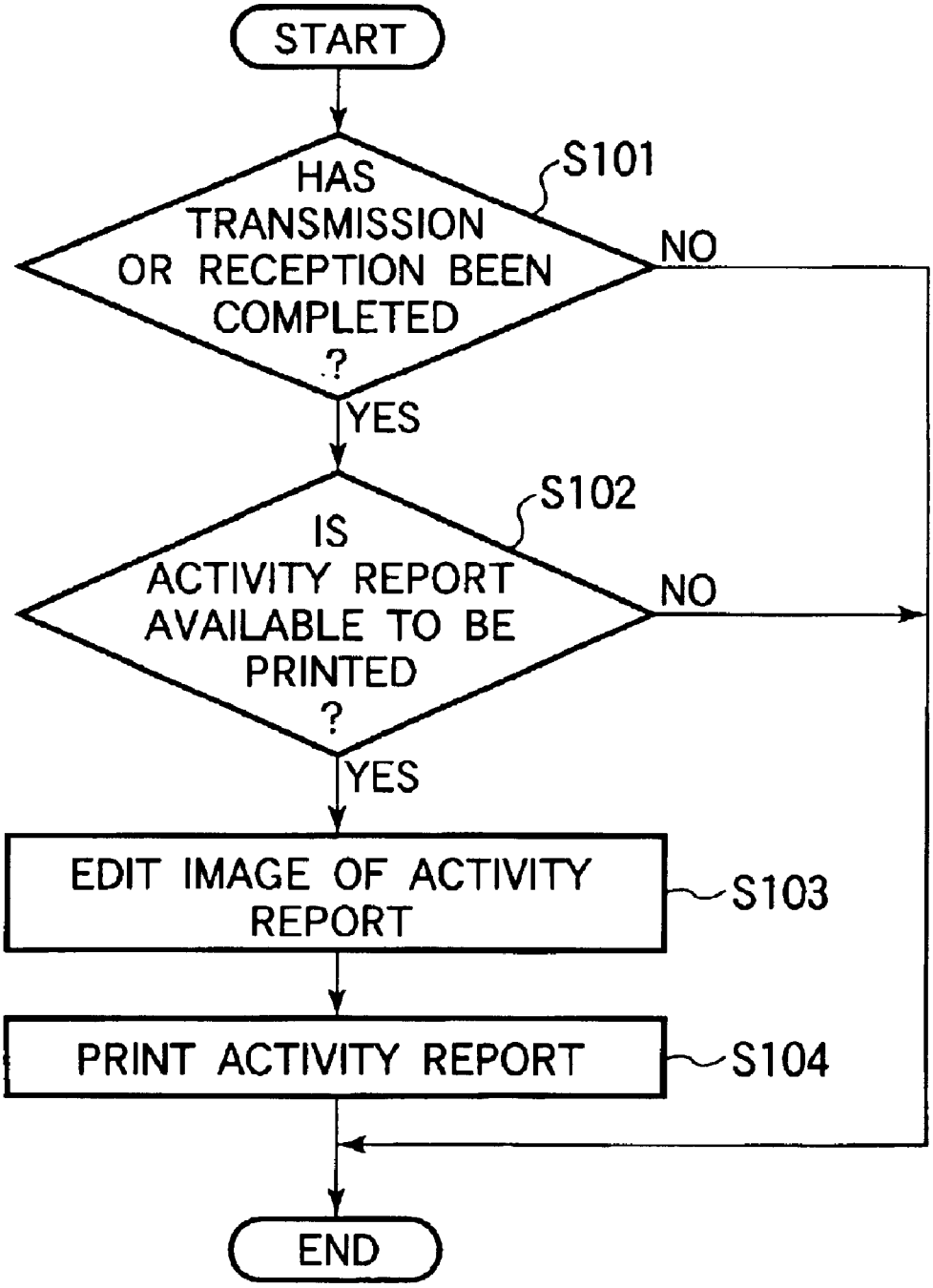
FIG. 11 is a flowchart illustrating the operation of the fifth embodiment.

FIG. 11 is a flowchart illustrating the operation of the fifth embodiment.

FIG. 12 illustrates an example of a checker flag pattern according to the fifth embodiment.

FIG. 13 illustrates an example of a solid black belt (strip) pattern according to the fifth embodiment.

The communication controller 26 carries out FAX communications over PSTN lines, FAX communications over ISDN lines, or internet FAX communications over LAN communications lines that incorporates a NIC (Network Interface Card), and then the communication data is stored in the RAM 13.

At step S101, a decision is made as to whether transmission or reception has been completed. Then, at step S102, a check is made to determine whether activity report data is available to be printed out. At step S103, the image editing section 27 reads activity report data from the RAM 13 and edits the activity report data as an image, and then transfers the edited image to the print controller 24, which in turn prints the image on a print medium at step S104. This operation allows printing of the activity report data of the past communications.

{Modification}

The apparatus may be modified in such a way that when the number of communications reaches a predetermined value, the activity report data is automatically printed out after a communication is completed. The predetermined number of communications is determined depending on the memory capacity of the RAM 13. An alternative modification is that the user operates the inputting device 30 to initiate printing of activity report data. If the activity report data is to be printed out after the communication has been completed, the activity report data stored in; the RAM 13 is erased only after the activity report data has been normally printed out.

The CPU 11 monitors the state of the image forming apparatus to determine after an individual communication whether the number of items of activity report data has reached a predetermined threshold value or whether the activity report data can be automatically printed out. If the activity report data can be automatically printed out, the CPU 11 controls the image editing section 27 to edit image data of the activity report that includes a checker flag pattern (checkered strip pattern) or a solid black belt (strip) pattern extending across the width of the print medium as shown in FIG. 12 and FIG. 13. Then, the CPU 11 stores the edited image data into the RAM 13 and then transfers the edited image data to the print controller 24, which in turn prints the edited image data on a print medium under the control of the CPU 11.

As described with respect to the above embodiment, printing is performed so that a checker flag pattern or a solid black belt pattern precedes an administration report such as activity report data that is printed out at regular intervals. Therefore, a pattern image is not printed at regular intervals on a print medium independently of other data. This prevents any printing that is not commanded by the user, and prevents waste of print medium.

A cleaning device as described in the sixth to eighth embodiments, which will be described later, may be provided so that the residual toner may be collected into the cleaning device instead of printing the checker flag pattern or solid black belt pattern on a print medium.

Sixth Embodiment

{Construction}

Figure 14:
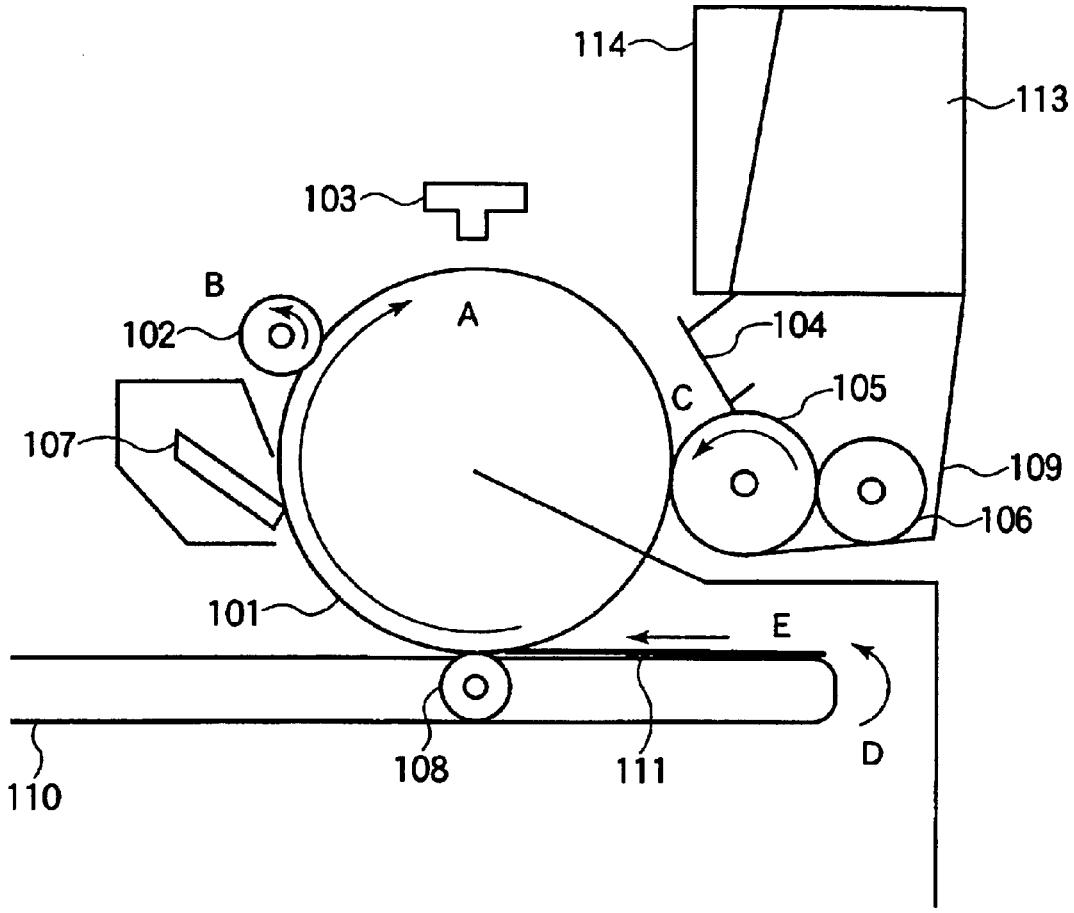
FIG. 14 illustrates a pertinent portion of an image forming apparatus according to a sixth embodiment.

FIG. 14 illustrates a pertinent portion of an image forming apparatus according to a sixth embodiment.

An image forming apparatus according to the sixth embodiment has much the same configuration as the first embodiment. The photoconductive drum 101 is, for example, an organic photoconductive drum. The charging roller 102 is made of a silicone resin or a urethane resin and rotates in a direction shown by arrow B. The exposing unit 103 takes the form of, for example, a laser head or an LED array head. The developing roller 105 is made of a silicone resin or a urethane resin. The toner supplying roller 106 is made of a foaming resin material such as urethane.

A toner cartridge 113 is detachably attached to the developing unit 109 that includes a developing blade 104, the developing roller 105, and the toner supplying roller 106. The toner cartridge 113 incorporates a waste toner chamber 114 that allows the user to take out the waste toner from the image forming apparatus when the toner cartridge 113 is replaced.

The toner held in the toner cartridge 113 is a micro-capsule toner having a particle diameter in the range of 5 to 7 $\mu$m. Micro-capsule toner is such that an inner low-glass point resin is enclosed with an outer high-lass point resin, so that the capsules prevent toner particles from sticking to one another during storage and melt easily at high temperatures during fixing.

{Operation}

The operation of the sixth embodiment will be described.

Referring to FIG. 14, the charging roller 102 receives a negative voltage from a power supply, not shown, and rotates in contact with the photoconductive drum 101 so that the surface of the photoconductive drum 101 is uniformly charged to a voltage of, for example, −850 V. The charged surface moves to a location directly below the exposing unit 103 as the photoconductive drum 101 rotates in a direction of arrow A. The exposing unit 103 illuminates the charged surface selectively in accordance with print data, thereby forming an electrostatic latent image on the photoconductive drum 101. Illuminated areas on the surface have a potential of about −50 V, which is much closer to 0 volts than the non-illuminated areas.

Then, the illuminated areas rotate into contact with the developing roller 105 that rotates in pressure contact with the photoconductive drum 101 in a direction shown by arrow C. The developing roller 105 applies toner to the electrostatic latent image to form a toner image.

The toner image then reaches a transfer point where the toner image is transferred onto a print medium 111 that is transported on the transfer belt 110 that runs in a direction shown by arrow D. The transfer belt 110 is sandwiched between the transfer roller 108 and the photoconductive drum 101 and receives a positive voltage of, for example, +1500 V from a power supply, not shown.

Figure 15:
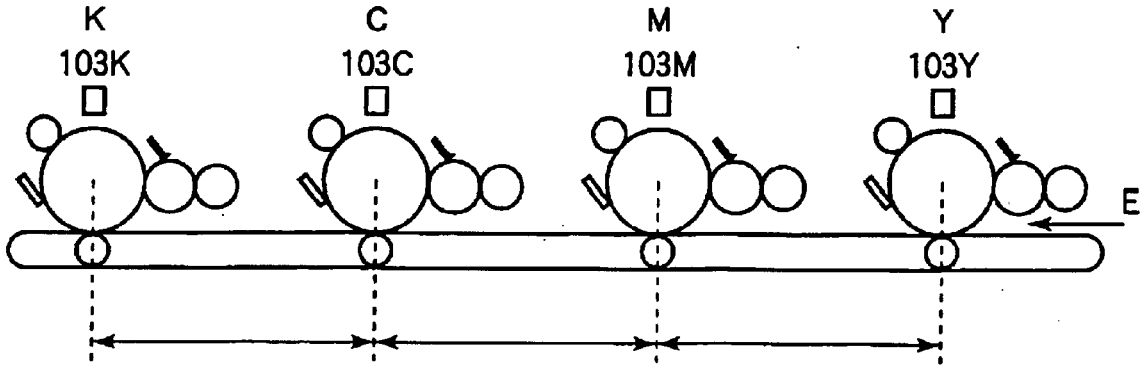
FIG. 15 illustrates a tandem type image forming apparatus according to the sixth embodiment.

FIG. 15 illustrates a tandem type image forming apparatus. Referring to FIG. 15, image forming sections Y, M, C, and K are aligned along a transfer belt 110 that runs in a direction shown by arrow E (FIG. 14). The print medium 111 is carried on the transfer belt 110 and passes through the image forming sections Y, M, C, and K in sequence.

Some toner fails to be transferred onto the print medium 111 during transfer, and remains as residual toner on the surface of the photoconductive drum 101. This residual toner is scraped off the photoconductive drum 101 by a cleaning blade 107. The photoconductive drum 101 then continues to rotate so that the surface of the photoconductive drum 101 is again charged uniformly by the charging roller 102.

Figure 16:
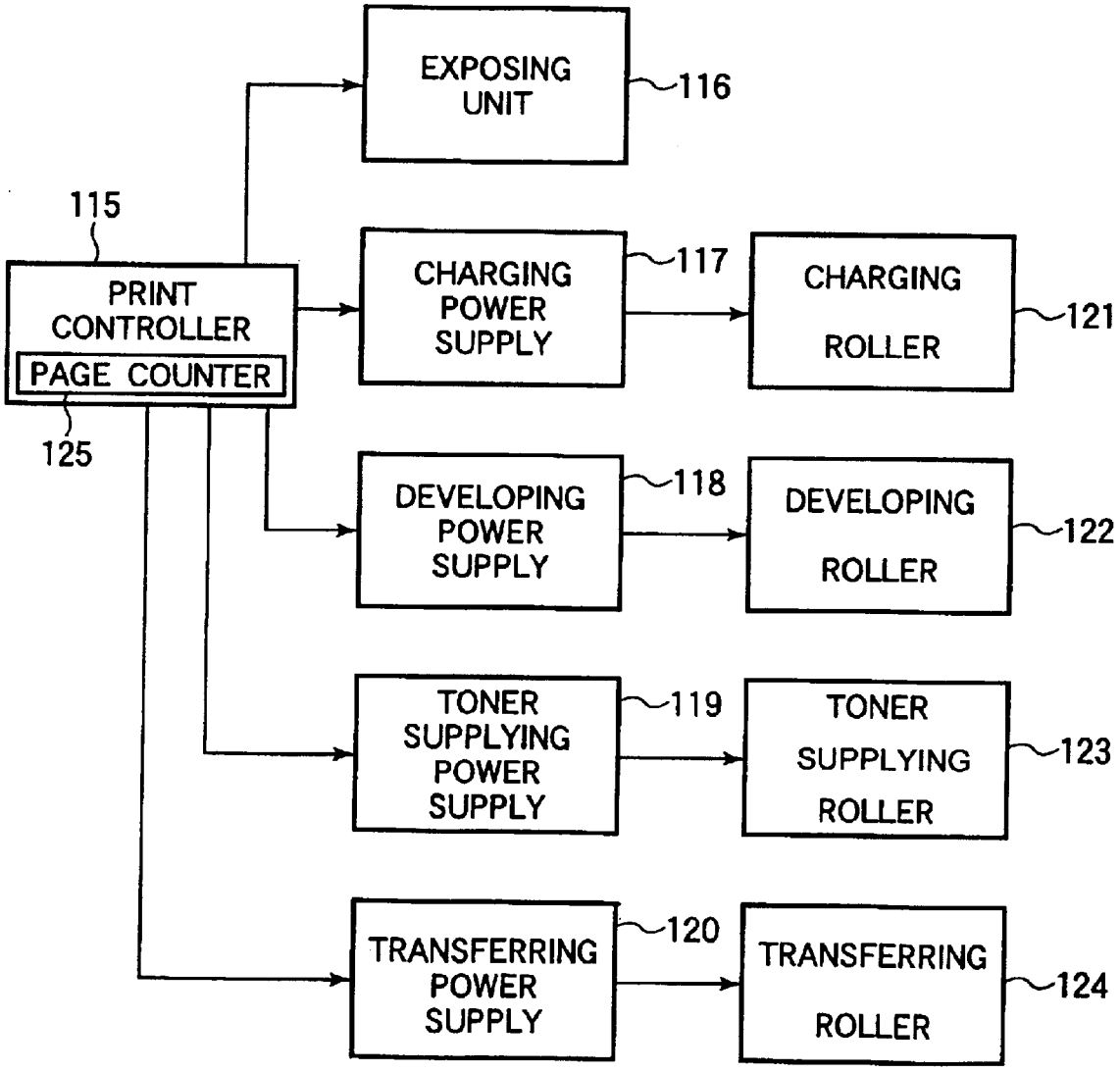
FIG. 16 illustrates a control block diagram according to the sixth embodiment.

FIG. 16 illustrates a control block diagram according to the sixth embodiment.

A print controller 115 controls an exposing unit 116, a charging power supply 117, a developing power supply 118, a toner supplying power supply 119, and a transferring power supply 120. The charging power supply 117 supplies a charging voltage to a charging roller 121. The developing power supply 118 supplies a developing voltage to a developing roller 122. The toner supplying power supply 119 supplies a toner supplying voltage to a toner supplying roller 123. The transferring power supply 120 supplies a transferring voltage to a transfer roller 124. The print controller 115 includes a page counter 125 that counts the cumulative number of printed pages.

{Discharging Waste Toner}

Figure 17:
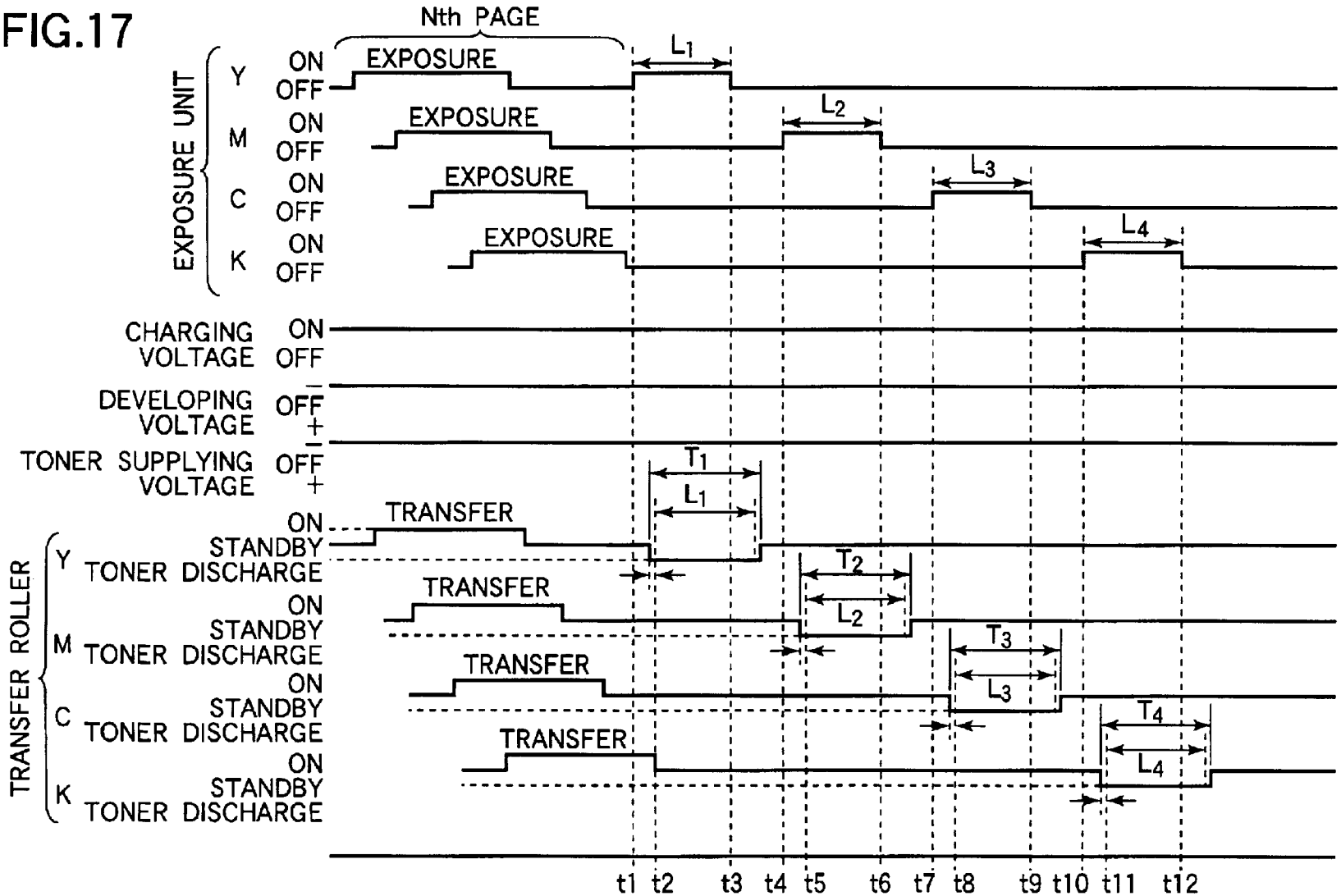
FIG. 17 is a timing chart illustrating the toner discharging operation according to the sixth embodiment.

FIG. 17 is a timing chart illustrating the toner discharging operation.

Referring to FIG. 17, a toner discharging operation is performed shortly after the exposure operation for printing the Nth page, as counted by the page counter 125.

Shortly after the exposing operation for the Nth page of print medium by the exposing unit 103K at the image forming section K, the exposing unit 103Y continues to illuminate the entire surface of the photoconductive drum 101 for a time length L1, starting at time t1. The time length L1 is determined in accordance with an amount of waste toner to be discharged.

Shortly before time t2, the transfer roller receives 0 volts. At time t2, the illuminated surface of the photoconductive drum 101 at the image forming section Y reaches the corresponding transfer roller 108. Most of the residual toner on that photoconductive drum 101 remains on the photoconductive drum 101 after the illuminated surface passes the transfer point. Then, the cleaning blade 107 at the image forming section Y scrapes residual toner off the photoconductive drum 101 and collects the residual toner into a cleaning device. The waste toner collected in the cleaning device is then delivered through a waste toner path, not shown, into a waste toner chamber 114.

The transfer roller 108 at the image forming section Y receives −400 V shortly before time t2 and continues to receive −400 V for the time length L1. For reliable operation, that transfer roller 108 should begin to receive −400 V sufficiently before time t2 and continue to receive for a somewhat longer time T1 than the time length L1, i.e., the time length L1 should be within the time length T1. If the transfer roller 108 receives 0 volts, a small amount of residual toner is transferred but most residual toner remains on the photoconductive drum 101. Therefore, the voltage applied to the transfer roller 108 is in the range of 0 to −400 V.

When the waste toner deposited on the transfer belt passes through the image forming sections Y, M, C, and K, the transfer rollers 108 at each of those respective four sections receive a standby voltage, which is between 0 volts and a transfer voltage (e.g., −400 V). This standby voltage is effective in holding the residual toner on the photoconductive drums without adversely affecting the photoconductive drums, so that the residual toner will not adhere to the photoconductive drums 101 at the respective sections M, C and K.

The exposing unit 103M begins to illuminate the entire surface of the corresponding photoconductive drum 101 at time t4. Subsequent operations are carried out in the same manner as the image forming section Y.

The exposing unit 103C begins to illuminate the entire surface of the corresponding photoconductive drum 101 at time t7. Subsequent operations of the image forming section C are carried out in the same manner as the image forming section Y.

The exposing unit 103K of the image forming section K begins to illuminate the entire surface of the corresponding photoconductive drum 101 at time t10. Subsequent operations are carried out in the same manner as the image forming section Y.

As described above, the residual toner is collected into the waste toner chamber 114 in the toner cartridge 113, so that the residual toner and agglomerated toner particles will not stay in the developing unit.

Collecting the waste toner in the waste toner chamber 114 is advantageous in that the waste toner can be taken out of the image forming apparatus when the toner cartridge 113 is replaced. Therefore, even if a large amount of toner is deteriorated, the deteriorated toner will not pile up in the cleaning device, which is usually small in capacity.

Seventh Embodiment

The sixth embodiment has been described with respect to a case in which all of the image forming sections Y, M, C, and K discharge the residual toner unconditionally. In practice, when the print duty is high, the toner is usually consumed before it is deteriorated, or deteriorated toner is used together with normal toner, eliminating the need for discharging deteriorated toner particles.

The operation of a seventh embodiment will be carried out with the timing shown in FIG. 17.

Figure 18:
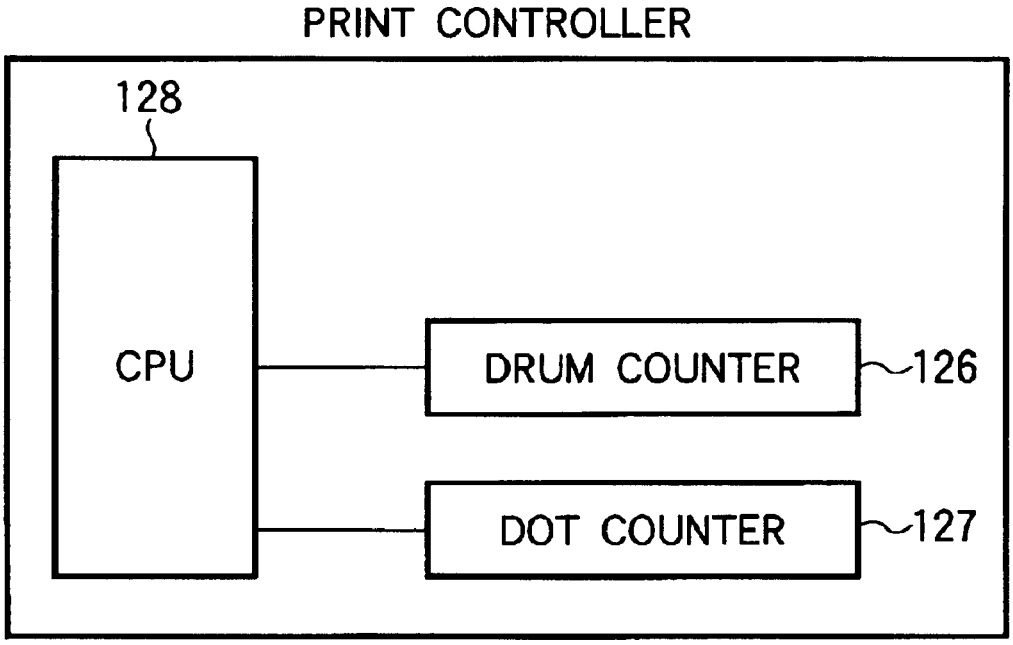
FIG. 18 illustrates a controller according to a seventh embodiment.

FIG. 18 illustrates the controller according to the sixth embodiment. The controller includes a CPU 128, a drum counter 126 that counts the cumulative number of rotations of the photoconductive drum, and a dot counter 127 that counts the cumulative number of print dots.

{Discharging Waste Toner}

Figure 19:
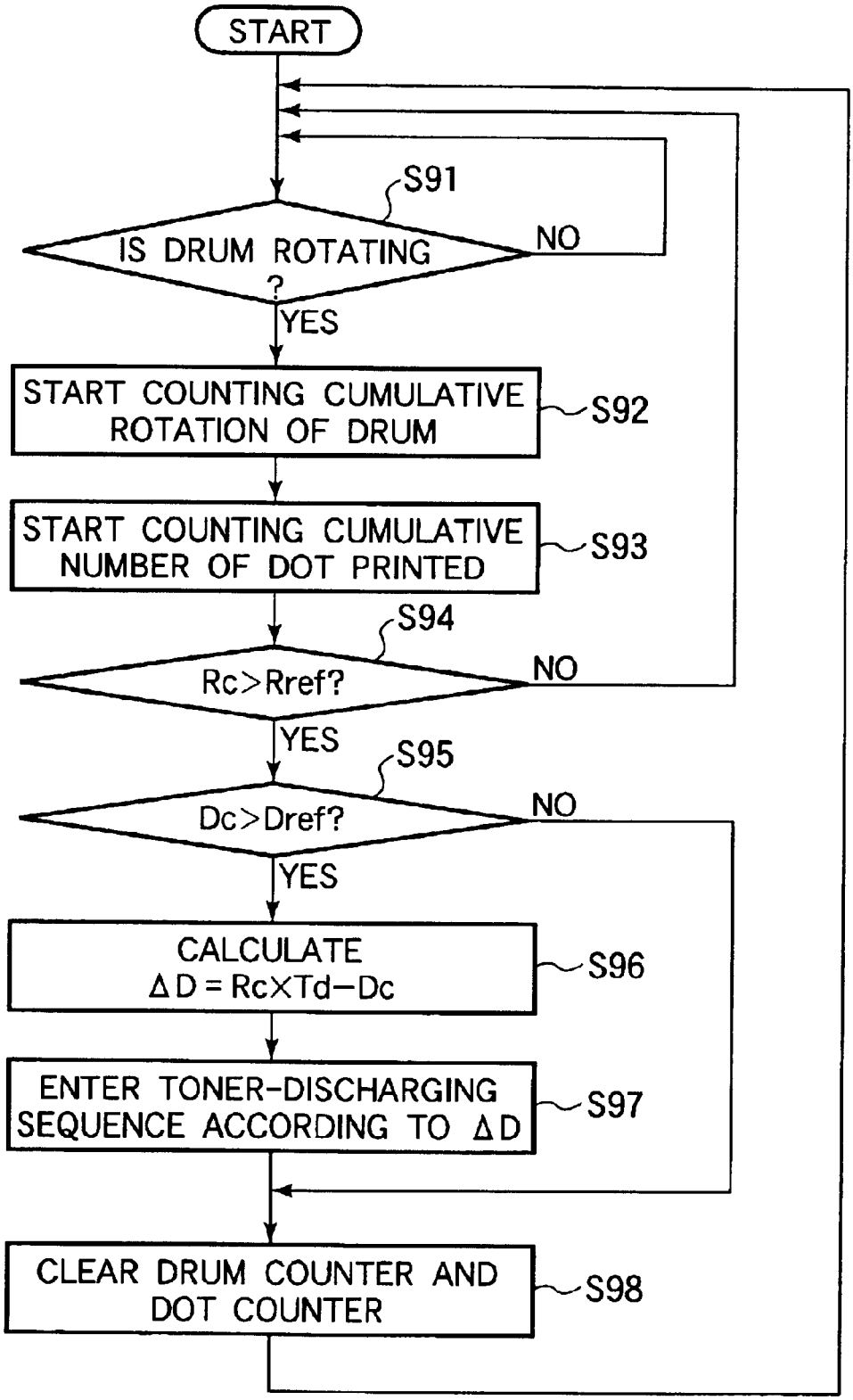
FIG. 19 is a flowchart illustrating the toner discharging operation.

FIG. 19 is a flowchart illustrating the toner discharging operation.

In the seventh embodiment, toner is discharged according to the cumulative counts of dots after the cumulative rotations of the photoconductive drum reach a predetermined value.

A drum counter 126 counts the cumulative rotation Rc of the photoconductive drum between toner discharging sequences. A dot counter 127 counts the number Dc of dots to be printed for a plurality of print jobs. An actual print duty Du is given by Du=Dc/(Rc×Td) where Td is the total number of dots printed when print duty is 100%.

Referring to FIG. 19, at step S91, a check is made to determine whether the photoconductive drum 101 is rotating.

At step S92, the drum counter 126 starts counting the cumulative rotation of the photoconductive drum 101. At step S93, the dot counter 127 counts the number of dots to be printed for a plurality of print jobs.

At step S94, a check is made to determine whether the content Rc of the drum counter 126 has reached or exceeded a predetermined reference value Rref. If NO at step S94, then the program jumps back to step S91. If YES at step S94, the program proceeds to step S95 where a check is made to determine whether the content Dc of the dot counter 127 has reached or exceeded a predetermined reference value Dref. If NO at step S95, then the program jumps to step S98. If YES at step S95, the program proceeds to step S96 where a difference ΔD between Rc×Td and Dc is calculated.

At step S97, upon completing printing of a page, the program enters the same toner discharging sequence as the first embodiment in which the exposing unit illuminates as many dots as the difference ΔD on the photoconductive drum 101 to print out a solid black belt pattern formed of dots in accordance with the difference ΔD.

At step S98, the drum counter 126 and the dot counter 127 are cleared, and the program loops back to step S91.

As described above, the seventh embodiment allows discharging of toner to particles equal to the difference ΔD between Dref and Dc. This operation discharges deteriorated toner efficiently while also reducing the chance of normal toner particles of being discharged.

Eighth Embodiment

The sixth embodiment has been described with respect to the timing at which various steps of the toner discharging operation are performed. The seventh embodiment has been described with respect to an algorithm through which the toner discharging operation is performed. However, simply discharging the toner results in increased consumption of toner. Thus, an eighth embodiment is directed to a saving of toner during the toner discharging operation.

Figure 20:
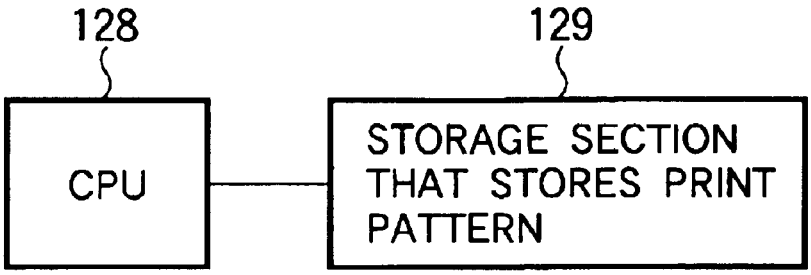
FIG. 20 illustrates a storage section in the controller of the image forming apparatus, the storage section storing a predetermined print pattern therein.

FIG. 20 illustrates a storage section 129 in the controller of the image forming apparatus, the storage section storing a predetermined print pattern therein.

Figure 21:
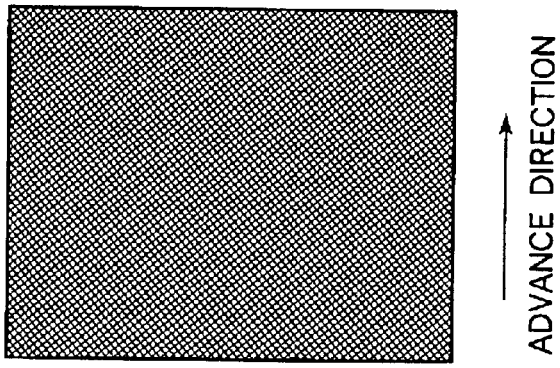
FIG. 21 illustrates one such toner discharging pattern in solid black according to an eighth embodiment.

FIG. 21 illustrates one such toner discharging pattern in solid black.

The use of a solid black pattern is very effective in discharging deteriorated toner. Toner particles at particular areas in the developing unit may be deteriorated preferentially depending on the printed images and circulation route of toner within the developing unit. If the toner discharging operation is performed on areas where toner is not significantly deteriorated, good toner will be discharged. If a sufficient amount of deteriorated toner is to be discharged from locations where toner deterioration is serious, then good, more normal toner will be discharged.

Toner deterioration at various locations in the developing unit will be described specifically.

Figure 22:
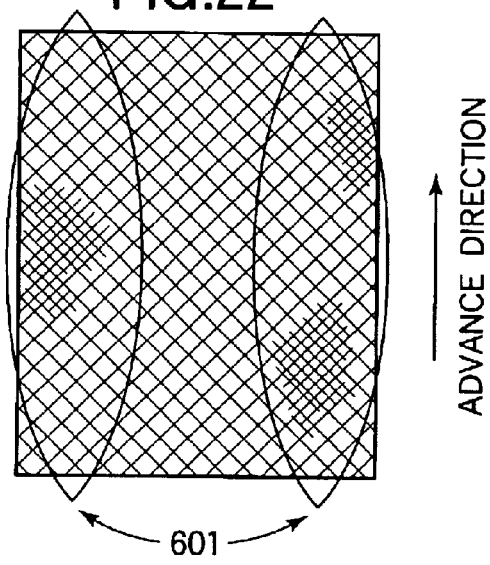
FIG. 22 illustrates a print result when a uniform half tone pattern is printed by using an image forming apparatus in which a detectable amount of damaged toner is accumulated in the image forming apparatus.

FIG. 22 illustrates a print result when a uniform half tone pattern is printed by using an image forming apparatus in which a detectable amount of damaged toner is accumulated in the image forming apparatus.

Figure 23:
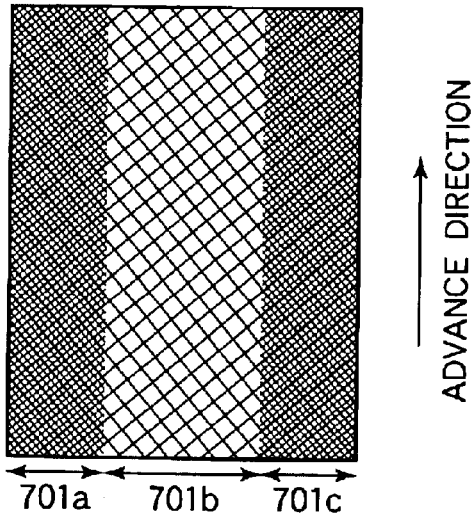
FIG. 23 illustrates a print result when a different amount of toner is discharged depending on areas in the print region.

FIG. 23 illustrates a print result when a different amount of toner is discharged depending on areas in the print region.

Referring to FIG. 22, non-uniformity (depicted at 601) of image density and poor reproducibility of dots are apt to occur at widthwise ends of the print medium.

In order to eliminate or alleviate the phenomenon shown in FIG. 22, the toner discharging pattern is divided into areas 701*a*, 701*b*, and 701*c* as shown in FIG. 23, and a toner discharging operation is performed so that more toner is discharged in the areas where toner deterioration is dominant. For example, the toner is discharged 100% for the areas 701*a* and 701*b* but only 50% for the area 701*b* between the areas 701*a* and 701*b*. This way of discharging deteriorated toner allows effective discharging of deteriorated toner while also saving normal good toner.

By using the cleaning device as described in the sixth to eighth embodiments, the residual toner may be discharged through the toner discharging conditions in the previously described first to fifth embodiments. That is, the deteriorated toner is discharged by printing on a print medium instead of collecting into a cleaning device.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

an electrophotographic image forming section, forming a toner image on a print medium; and a controller, causing said image forming section to form a toner image of a pattern image on the print medium every time a cumulative operation reaches a predetermined value before the toner in the image forming apparatus is exhausted, the toner image of the pattern image being formed independently of a remaining amount of toner in the image forming apparatus.

2. The image forming apparatus according to claim 1, wherein the cumulative operation is one of a number of print jobs, a number of printed pages, and a number of rotations of an image drum.

3. The image forming apparatus according to claim 1, wherein said image forming section includes a photoconductive drum, and wherein said image forming section further includes:

a charging unit that uniformity charges a surface of the photoconductive drum;

an exposing unit that illuminates the charged surface of the photoconductive drum to form an electrostatic latent image of a predetermined pattern image in accordance with a difference between a reference print duty and an actual print; and a developing unit that supplies the toner to the electrostatic latent image.

4. The image forming apparatus according to claim 1, wherein the pattern of the pattern image is adapted so that the toner image thereof on the print medium discharges deteriorated toner from a toner reservoir of the image forming apparatus.

5. The image forming apparatus according to claim 4, wherein the pattern of the pattern image is either a uniform strip or is checkered, and extends substantially across a width of the print medium in a direction intersecting a direction in which the print medium is advanced.

6. The image forming apparatus according to claim 4, wherein the pattern of the pattern image is a uniformly colored strip and extends across a width of the print medium in a first direction at an angle with a second direction in which the print medium is advanced.

7. The image forming apparatus according to claim 4, wherein the pattern of the pattern image has a plurality of solid print areas on a line that extends across the print medium in first direction at an angle with a second direction in which the print medium is advanced, the plurality of solid print areas including first and second solid print areas alternating with each other and aligned such that the first solid print areas are on one side of the line and the second solid print areas are on the other side of the line, each first solid print area being contiguous with an adjacent second solid print area.

8. An image forming apparatus, comprising an electrophotographic image forming section, forming a toner image on a print medium; and a controller, causing said image forming section to form a toner of a pattern image on the print medium when a cumulative operation reaches a predetermined value, wherein the cumulative operation is a number of printed pages having a print duty less than a predetermined value.

9. An image forming apparatus, comprising an electrophotographic image forming section, forming a toner image on a print medium; and a controller, causing said image forming section to form a toner image of a pattern image on the print medium when a cumulative operation reaches a predetermined value, wherein the pattern image is at least one of a number of pattern images aligned in an advance direction, the number of pattern images being increased in accordance with a print duty.

10. The image forming apparatus according to claim 9, wherein said controller divides a print region of the print medium into a plurality of sub-divided areas that are aligned in an advance direction, and calculates a cumulative print duty in each one of the plurality of sub-divided areas and causes said image forming section to print the pattern image in a sub-divided area in which the cumulative print duty is less than a predetermined value.

11. An image forming apparatus, comprising an electrophotographic image forming section, forming a toner image on a print medium; and a controller, causing said image forming section to form a toner image of a pattern image on the print medium when a cumulative operation reaches a predetermined value, wherein said controller causes said image forming section to print an activity report at predetermined time intervals and the pattern image together with the activity report on the print medium.

12. An image forming apparatus, comprising an electrophotographic image forming section, forming a toner image on a print medium; and a controller, causing said image forming section to form a toner image of a pattern image on the print medium when a cumulative operation reaches a predetermined value, wherein said forming section includes a photoconductive drum, a developing unit that supplies toner to the photoconductive drum to form the toner image, a transfer unit that transfers the toner image from the photoconductive drum to the print medium, and a cleaning unit that collects waste toner from the photoconductive drum, and wherein when the waste toner is collected from the image forming section, said transfer unit receives such a voltage that no transfer of toner occurs between the photoconductive drum and the transfer unit so that the waste toner is collected through the cleaning unit.

13. An image forming apparatus, comprising an electrophotographic image forming section, forming a toner image on a print medium; and a controller, causing said image forming section to form a toner image of a pattern image on the print medium when a cumulative operation reaches a predetermined value, wherein said controller divides a print region of the print medium into three areas that are aligned in a traverse direction, an area between two areas having a smaller print duty than the two areas.

14. A method of controlling an image forming apparatus, the method comprising the steps of:

causing an electrophotographic image forming section to form a toner image on a print medium; and causing said image forming section to form a toner image of a pattern image on the print medium every time a cumulative operation reaches a predetermined value before the toner in the image forming apparatus is exhausted, the toner image of the pattern image being formed independently of a remaining amount of tone in the image forming apparatus.

15. The method of controlling an image forming apparatus according to claim 14, wherein the cumulative operation is one of a number of print jobs, a number of printed pages, and a number of rotations of an image drum.

16. The method of controlling an image forming apparatus according to claim 14, wherein said image forming section further includes:

a photoconductive drum, a developing unit, a charging unit that uniformly charges a surface of the photoconductive drum, and an exposing unit that illuminates the charged surfaced of the photoconductive drum to form an electrostatic latent image of a predetermined pattern image in accordance with a difference between a predetermined amount of printing and a number of actually printed dots; and wherein the method further comprises causing the developing unit to supply the toner to the electrostatic latent image.

17. A method of controlling an image forming apparatus, comprising the steps of:

causing an electrophotographic image forming section to form a toner on a print medium; and causing said image forming section to form a toner image of a pattern on the print medium when a cumulative operation reaches a predetermined value, wherein the cumulative operation is a number of printed pages having a print duty less than a predetermined value.

18. A method of controlling an image forming apparatus, comprising the steps of:

causing an electrophotographic image forming section to form a toner image on a print medium; and causing said image forming section to form a toner image of a pattern image on the print medium when a cumulative operation reaches a predetermined value, wherein the pattern image is at least one of a number of pattern images aligned in an advance direction, the number of pattern images being increased in accordance with a print duty.

19. A method of controlling an image forming apparatus, comprising the steps causing an electrophotographic image forming section to form a toner image on a print medium;

causing said image forming section to form a toner image of a pattern image on the print medium when a cumulative operation reaches a predetermined value, dividing a print region of the print medium into a plurality of sub-divided areas that are aligned in a advance direction; and calculating a cumulative print duty in each one of the plurality of sub-divided areas and causes said image forming section to print the pattern image in a sub-divided area in which the cumulative print duty is less than a predetermined value.

20. A method of controlling an image forming apparatus, comprising the steps of:

causing an electrophotographic image forming section to form a toner image on a print medium;

causing said image forming section to form a toner image of a pattern image on the print medium when a cumulative operation reaches a predetermined value, and causing said image forming section to print an activity report at predetermined time intervals and the pattern image together with the activity report on the print medium.

21. A method of controlling an image forming apparatus, comprising the steps of:

causing an electrophotographic image forming section to form a toner image on a print medium, wherein said image forming section includes a photoconductive drum, a developing unit that supplies toner to the photoconductive drum to form the toner image, a transfer unit that transfers the toner image from the photoconductive drum to the print medium, and a cleaning unit that collects waste toner from the photoconductive drum;

causing said image forming section to form a toner image of a pattern image on the print medium when a cumulative operation reaches a predetermined value; and applying such a voltage that no transfer of toner occurs between the photoconductive drum and the transfer unit so that the waste toner is collected through the cleaning unit, the voltage being applied when the waste toner is collected from the image forming section.

22. A method of controlling an image forming apparatus, comprising the steps of:

causing an electrophotographic image forming section to form a toner image on a print medium;

causing said image forming section to form a toner image of a pattern image on the print medium when a cumulative operation reaches a predetermined value; and dividing a print region of the print medium into three areas that are aligned in a traverse direction, an area between two areas having a smaller print duty than the two areas.

* * * * *